US009435578B2

(12) United States Patent
Calderon et al.

(10) Patent No.: US 9,435,578 B2
(45) Date of Patent: Sep. 6, 2016

(54) STORAGE APPARATUSES AND RELATED METHODS FOR STORING TEMPERATURE-SENSITIVE ITEMS

(71) Applicant: Tokitae LLC, Bellevue, WA (US)

(72) Inventors: Ryan Calderon, Seattle, WA (US); Fong-Li Chou, Issaquah, WA (US); Michael Friend, Seattle, WA (US); David Gasperino, Lake Forest Park, WA (US); Shieng Liu, Bellevue, WA (US); Matthew F. Rosen, Seattle, WA (US); Shannon Weise Stone, Redmond, WA (US); Ozgur Emek Yildirim, Bellevue, WA (US)

(73) Assignee: TOKITAE LLC, Bellevue, WA (US)

( * ) Notice: Subject to any disclaimer, the term of this patent is extended or adjusted under 35 U.S.C. 154(b) by 273 days.

(21) Appl. No.: 14/098,130

(22) Filed: Dec. 5, 2013

(65) Prior Publication Data

US 2015/0159924 A1 Jun. 11, 2015

(51) Int. Cl.
*F25B 21/02* (2006.01)
*F25D 11/00* (2006.01)

(52) U.S. Cl.
CPC ..... *F25D 11/006* (2013.01); *F25B 21/02* (2013.01); *F25D 2400/10* (2013.01)

(58) Field of Classification Search
CPC ..... F25B 21/02; F25D 2400/12
USPC ..... 62/3.3, 3.6, 3.62, 3.7, 457.1, 371, 530; 165/104.33
See application file for complete search history.

(56) References Cited

U.S. PATENT DOCUMENTS

| | | | | |
|---|---|---|---|---|
| 4,593,529 | A * | 6/1986 | Birochik | F17C 13/02 62/3.3 |
| 4,961,320 | A | 10/1990 | Gutmann | |
| 5,934,079 | A * | 8/1999 | Han | H04B 1/036 62/259.2 |
| 6,308,518 | B1 * | 10/2001 | Hunter | F25B 21/02 62/3.3 |
| 6,658,857 | B1 | 12/2003 | George | |
| 2003/0062150 | A1 * | 4/2003 | Sweitzer | H01L 23/38 165/104.33 |
| 2006/0117761 | A1 * | 6/2006 | Bormann | F25B 21/02 62/3.6 |
| 2009/0049845 | A1 | 2/2009 | McStravick et al. | |
| 2009/0158770 | A1 | 6/2009 | Cohrs et al. | |
| 2011/0088413 | A1 * | 4/2011 | Lampe | C09K 5/066 62/68 |
| 2012/0125014 | A1 | 5/2012 | Hercil et al. | |

OTHER PUBLICATIONS

PCT International Search Report; International App. No. PCT/US2014/067862; Mar. 19, 2015; pp. 1-4' .

* cited by examiner

*Primary Examiner* — Melvin Jones
(74) *Attorney, Agent, or Firm* — Dorsey & Whitney LLP

(57) ABSTRACT

Embodiments disclosed herein relate to apparatuses and methods for storing temperature-sensitive items. More specifically, embodiments include a storage apparatus that may store the temperature-sensitive items. For example, the storage apparatus may include a storage compartment that may be maintained at a predetermined temperature or temperature range.

48 Claims, 10 Drawing Sheets

STORAGE APPARATUSES AND RELATED METHODS FOR STORING TEMPERATURE-SENSITIVE ITEMS

BACKGROUND

Various materials and substances require storage at a specific temperature or temperature range. For instance, some temperature-sensitive substances or materials may require near-freezing temperature to avoid spoilage. Among others, examples of temperature-sensitive items include pharmaceuticals, biologicals, and food.

Maintaining a near-freezing temperature in some environments may require a temperature-controlled storage space that can be cooled (e.g., relative to the temperature of ambient air). In some instances, cooling the temperature-controlled storage space may require electrical power, which may be drawn from an electrical grid or other main power source. Interruptions in power supply or changes in the environment, such as increase or decrease in temperature of the ambient air may affect the temperature in the temperature-controlled space, which may damage or spoil the temperature-sensitive items.

Thus, manufacturers continue to seek improved devices and methods for storing temperature-sensitive substances.

SUMMARY

Embodiments disclosed herein relate to apparatuses and methods for storing temperature-sensitive items. In an embodiment, a storage apparatus for storing at least one temperature-sensitive material at a controlled temperature is disclosed. The storage apparatus includes an enclosure structure having a storage compartment configured to hold the at least one temperature-sensitive material, and a thermal transfer assembly adjacent to and in thermal communication with the storage compartment. The thermal transfer assembly includes a phase change material disposed therein, one or more heat pipes positioned at least partially within the phase change material, and a plurality of thermally conductive fins in thermal communication with the one or more heat pipes and positioned at least partially within the phase change material. The storage apparatus further includes a thermoelectric heat pump in thermal communication with the one or more heat pipes, a heat sink in thermal communication with the thermoelectric heat pump, and at least one temperature sensor configured to measure temperature in at least one of the storage compartment or the thermal transfer assembly. The storage apparatus also includes a controller operably coupled to the thermoelectric heat pump and to the at least one temperature sensor. The controller is configured to direct the thermoelectric heat pump to controllably cool the phase change material so that a temperature of the storage compartment is controlled responsive to information from the at least one temperature sensor.

In an embodiment, a method of maintaining at least one temperature-sensitive material in a storage apparatus at a temperature lower than an ambient temperature is disclosed. The method includes placing the at least one temperature-sensitive material in a storage compartment of the storage apparatus that is adjacent to and in thermal communication with a thermal transfer assembly of the storage apparatus having a phase change material disposed therein. The method further includes controllably changing a phase of a portion of the phase change material by removing heat therefrom via one or more heat pipes attached to a thermoelectric heat pump so that a first portion of the phase change material is in a solid phase and a second portion of the phase change material is in a liquid phase that is disposed between the storage compartment and the first portion.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1A:
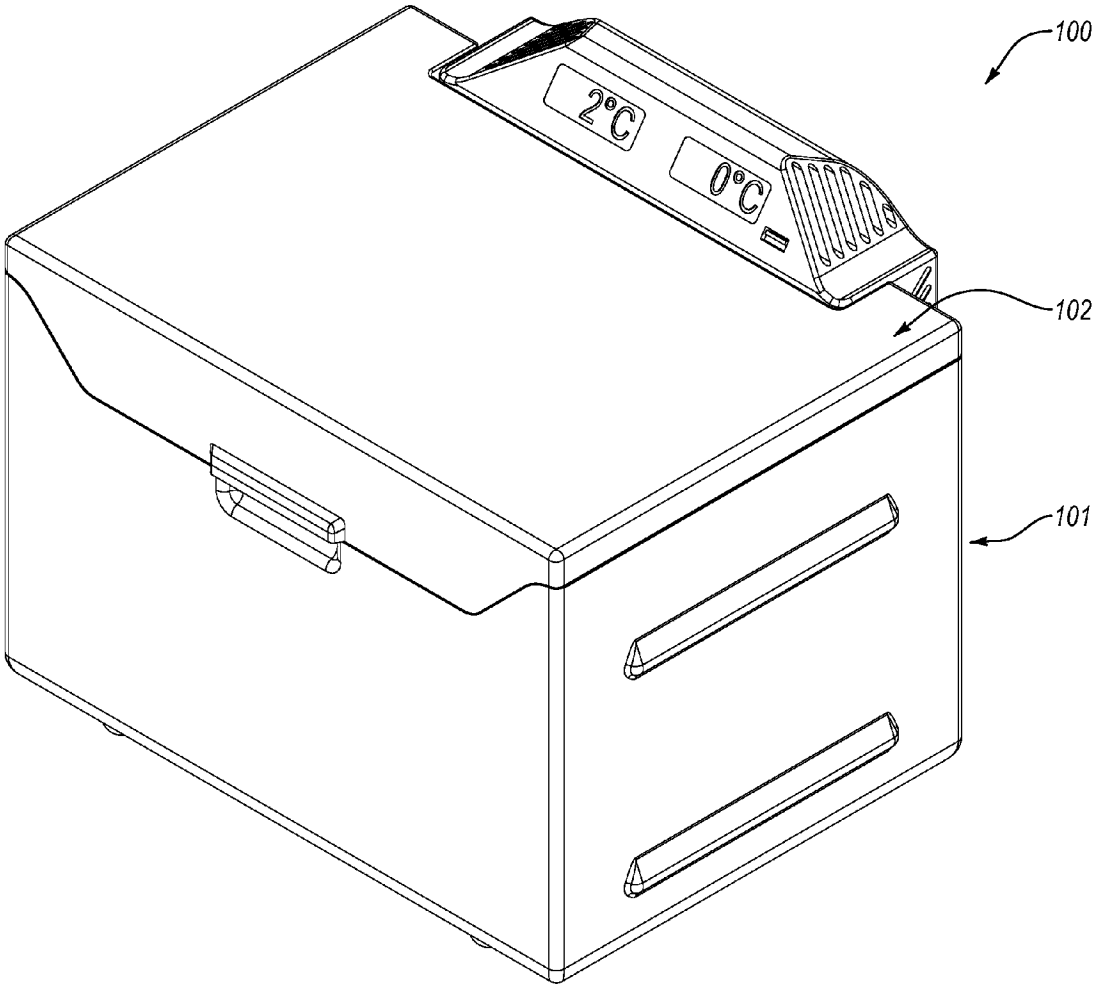
FIG. 1A is an isometric view of a storage apparatus with a closed lid according to an embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Embodiments disclosed herein relate to apparatuses and methods for storing temperature-sensitive items. More specifically, at least some embodiments include a storage apparatus that may store the temperature-sensitive items. For example, the storage apparatus may include a storage compartment that may be maintained at a predetermined temperature or temperature range. In some embodiments, the temperature in the storage compartment may be lower than the temperature outside of the storage apparatus or ambient temperature. As such, the storage apparatus may store temperature-sensitive items at a lower temperature than the ambient temperature.

In some embodiments, the storage apparatus may maintain the storage compartment at approximately the same temperature or approximately within the same temperature range in the absence of external supply of electrical power. For instance, the storage compartment may be maintained at a predetermined temperature for one or more days without external power supply (e.g., 1 to 3 days). Accordingly, the storage apparatus may be deployed in locations or applications that may lack a reliable or constant supply of electrical power (e.g., away from an electrical grid).

Figure 1B:
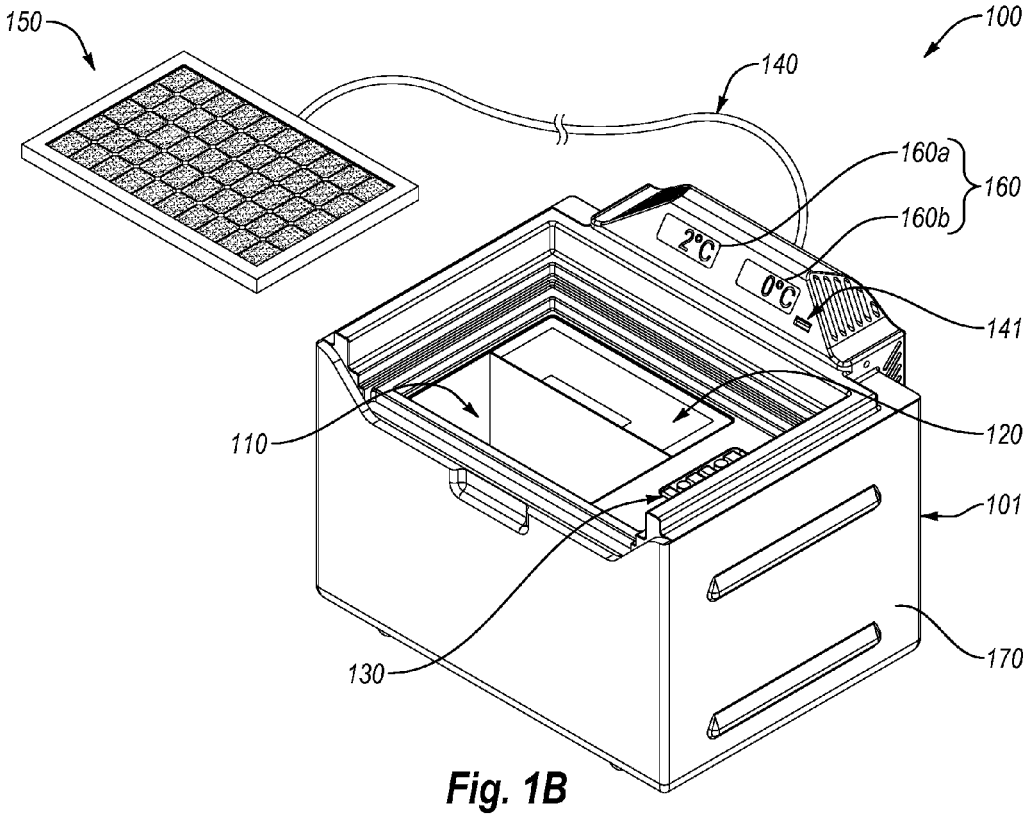
FIG. 1B is an isometric view of a storage apparatus without the lid and connected to a power source according to an embodiment.
Figure 1C:
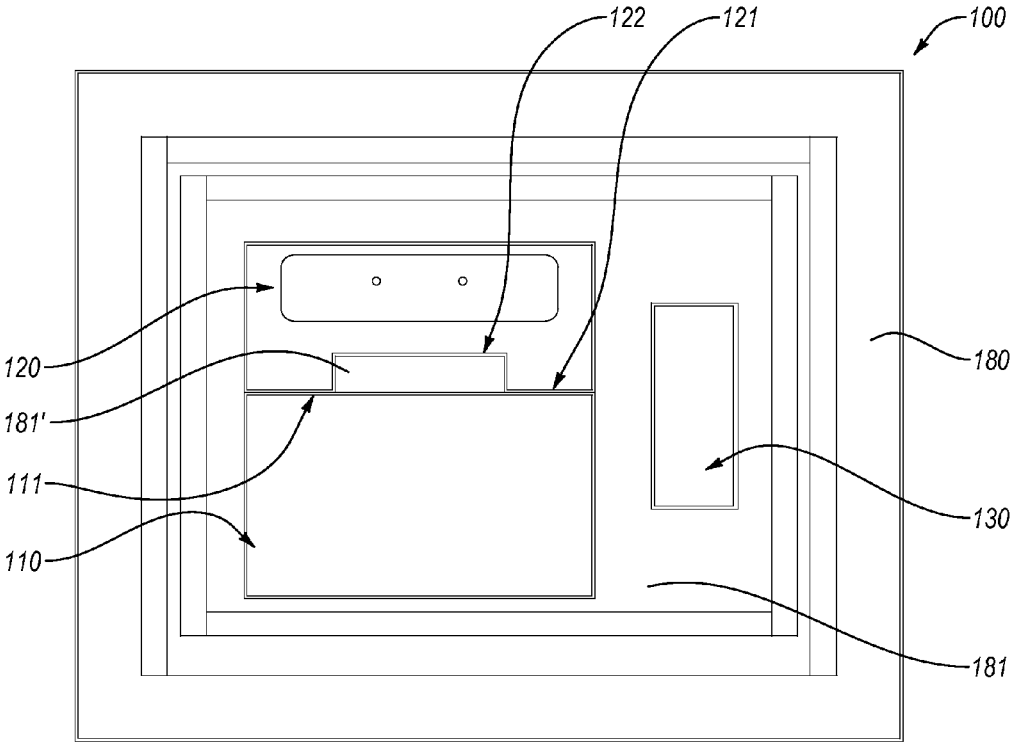
FIG. 1C is a partial top view of the storage apparatus of FIG. 1B.

FIGS. 1A-1C illustrate an embodiment of a storage apparatus 100. As described below in more detail, the storage apparatus 100 may include one or more storage compartments, which may be maintained at a predetermined temperature or temperature range. In some embodiments, the storage apparatus 100 may include a main housing 101 and a lid 102, as illustrated in FIG. 1A. In some instances, the lid 102 may be removably attached to the main housing 101. In other words, the lid 102 may be completely removed from the main housing 101 to provide access to the compartments located in the main housing 101. Conversely, the lid 102 may be reattached to the main housing 101 to close the compartments located in the main housing 101.

It should be appreciated that, generally, the lid 102 may be attached to the main housing 101 with any number of suitable mechanisms. For instance, the lid 102 may be connected to the main housing with one or more hinges. Also, the lid 102 may be slidingly or otherwise attached to the main housing 101, in a manner that movement or rotation of the lid 102 may open and close access to the storage compartments in the main housing 101. In any event, however, the lid 102 may be attached to the main housing in a manner that may selectively provide access to the compartments of the storage apparatus 100.

As mentioned above, the storage apparatus 100 may include one or more compartments (e.g., compartments for storing temperature-sensitive items). In particular, in an embodiment illustrated in FIG. 1B, the main housing 101 of the storage apparatus 100 includes a storage compartment 110 and a thermal transfer assembly 120, which may cool the storage compartment 110 to a suitable or predetermined temperature. Moreover, the thermal transfer assembly 120 may maintain the storage compartment 110 at a suitable or predetermined temperature or temperature range. In some embodiments, the thermal transfer assembly 120 may maintain the storage compartment 110 at a near-freezing temperature, as described below in further detail.

In the illustrated embodiment, the storage apparatus 100 may include a freezer compartment 130 located in the main housing 101, which may be maintained at or below freezing temperature (e.g., at or below 0° C.). However, in other embodiments, the freezer compartment 130 may be omitted. In an embodiment, the freezer compartment 130 may store items that may require temperature of below 0° C. to avoid spoliation. In an embodiment, the freezer compartment 130 may store items that may require temperature of below 0° C. and above −25° C. to maintain quality. In an embodiment, the freezer compartment 130 may freeze ice, or WHO-approved medical ice packs, to a temperature below 0° C. and above −10° C. Moreover, similar to the storage compartment 110, the freezer compartment 130 may maintain the temperature therein at predetermined level or range in the absence of electrical power.

To cool or maintain a predetermined temperature in the thermal transfer assembly 120 or freezer compartment 130, the storage apparatus 100 may be coupled to an electrical power source. For example, the storage apparatus 100 may include an electrical connection 140 that may electrically couple the storage apparatus 100 to the electrical power source. In an embodiment, the power source may supply power to one or more heat pumps that may regulate the temperature in the storage compartment 110 or the freezer compartment 130, as described below.

The particular source of power may vary from one embodiment to the next, and may include an alternating or direct current sources. In an embodiment, the storage apparatus 100 may connect to a power source 150 that may supply direct current power thereto. For instance, the power source 150 may be a solar panel, a battery (e.g., a rechargeable battery), or the like as well as combinations of such power supplies. For example, the storage apparatus may be electrically coupled to a solar panel that may produce 100-160 W of direct current power.

Hence, in an embodiment, the storage apparatus 100 may accept direct current power. In an embodiment, the storage apparatus 100 may connect to a power source that may provide alternating current, such as a generator, a main power grid, or the like. As such, the storage apparatus 100 may operate from direct or alternating current.

Additionally or alternatively, the storage apparatus 100 may include a power inverter to convert direct current to alternating current, and may operate on alternating current. Conversely, the storage apparatus 100 may include a rectifier to convert alternating current to direct current and may operate on direct current. Consequently, in an embodiment, the storage apparatus 100 may accept direct and alternating current for operation thereof and may be connected to a power source that provides either direct or alternating current.

In an embodiment, the storage apparatus 100 also may include an auxiliary power supply port. More specifically, the storage apparatus 100 may receive or dispense power via the auxiliary power supply port. For instance, the storage apparatus 100 may include a Universal Serial Bus (USB) port 141. The USB port 141 may supply power to auxiliary devices, such as mobile phones. In an embodiment, the USB port 141 may be configured to receive power (e.g., to charge an optional battery).

While the storage apparatus 100 may include any of the storage compartment 110, thermal transfer assembly 120, or freezer compartment 130, in some embodiments, the storage apparatus 100 may include only a single compartment or dual compartments. For instance, the storage apparatus 100 may include only the freezer compartment 130. Also optionally, the storage compartment 110 and thermal transfer assembly 120 may be integrated together in a manner to form a single storage compartment that may maintain temperature-sensitive items at a suitable temperature or temperature range.

As described below in further detail, the storage apparatus 100 may include a controller that may monitor the temperature in one or more of the storage compartment 110, thermal transfer assembly 120, or freezer compartment 130 and may direct a heat pump on and off time or heat exchange production thereof. Additionally, the storage apparatus 100 may include one or more displays, which may provide visual information about the temperature in the storage compartment 110, thermal transfer assembly 120, freezer compartment 130, or combinations thereof. For instance, the storage apparatus 100 may include displays 160, such as displays 160*a*, 160*b*, which may show temperature readings from the storage compartment 110 and freezer compartment 130, respectively.

Thus, for example, a user may monitor the temperature readings from the storage compartment 110 or freezer compartment 130. More specifically, as the power supply becomes unavailable to the storage apparatus 100, the user may monitor the displays 160 to make sure that the temperature in the storage compartment 110 or freezer compartment 130 remains at suitable levels. Moreover, in addition to or in lieu of the displays 160, the storage apparatus 100 may include an audible monitor that may provide an audible alter if the temperature in any of the storage compartment 110, thermal transfer assembly 120, or freezer compartment 130 falls below a suitable level, which may be preset (e.g., by a user, by a manufacturer, by a supplier of temperature-sensitive items, etc.). The displays 160 also may optionally provide an alert if the storage apparatus 100 stops receiving power from a power source.

In an embodiment, the main housing 101 also may include an outer shell 170. For example, the storage compartment 110 or the thermal transfer assembly 120 may be positioned within an outer shell 170, which may secure or protect the storage compartment 110 and the thermal transfer assembly 120. For instance, among other things, the outer shell 170 may protect the storage compartment 110 or the thermal transfer assembly 120 from impact, from environmental effects or conditions, such as debris, dust, and liquids. The outer shell 170 may include any suitable material, which may vary from one embodiment to another. In some instances, the outer shell 170 may include polycarbonate, nylon, fiberglass, or the like. Moreover, the outer shell 170 may include thermally insulating material (e.g., thermoplastic material), which may at least partially insulate the storage compartment 110, thermal transfer assembly 120, freezer compartment 130, or combinations thereof.

The lid 102 (FIG. 1A) may include the same or similar material as the outer shell 170 of the main housing 101. Furthermore, the lid 102 (FIG. 1A) may include an outer shell comprising the same or similar material as the outer shell 170, which may at least partially encapsulate thermally insulating material of the lid (e.g., polyurethane foam or the like). In any event, the materials comprising the lid 102 (FIG. 1A) and the outer shell 170 and configurations thereof (e.g., thicknesses, shapes, such as ribs and other stiffening features, etc.) may provide sufficient structural rigidity and strength to the main housing 101 and the lid.

Likewise, the main housing 101 may include thermally insulating material that may at least partially surround or encapsulate one or more of the storage compartment 110, thermal transfer assembly 120, or freezer compartment 130. As shown in FIG. 1C, any of the storage compartment 110, thermal transfer assembly 120, or freezer compartment 130 may be at least partially surrounded by insulation, such as thermal insulation 180. The thermal insulation 180 may reduce heat exchange between the storage compartment 110, thermal transfer assembly 120, or freezer compartment 130 and the environment outside of the storage apparatus 100, such as ambient air.

Suitable thermal insulation 180 may change from one embodiment to another, and may depend, among other things, on the intended or anticipated outside environment. Suitable materials for the thermal insulation 180 include but are not limited to foam, such as polyurethane foam, blocks with low thermal conductivity medium (e.g., gas, liquid, semi-liquid, or solid, which may include xenon, argon, air, polystyrene, alumina, asbestos, etc.). The thermal insulation 180 also may include high performance insulation such as vacuum blocks, aerogel, or other materials or structures that may have thermal conductivity that is less than thermal conductivity of blown polyurethane (e.g., less than 0.3 W/m/K).

In an embodiment, the storage apparatus 100 also may include thermal insulation between at least some of the storage compartment 110, thermal transfer assembly 120, or freezer compartment 130. For example, thermal insulation 181 may at least partially surround one or more of the storage compartment 110, thermal transfer assembly 120, or freezer compartment 130. In an embodiment, the freezer compartment 130 may be adjacent to the storage compartment 110 and to the thermal transfer assembly 120 (e.g., the freezer compartment 130 may be separated from the storage compartment 110 and thermal transfer assembly 120 by a wall, such as a wall formed by the thermal insulation 181). The thermal insulation 181 may facilitate the storage compartment 110, thermal transfer assembly 120, and freezer compartment 130 with different temperatures therein one from another. In other words, the thermal insulation 181 may impede or prevent conductive heat transfer between the storage compartment 110, thermal transfer assembly 120, and freezer compartment 130, thereby facilitating different temperatures therein.

In some instances, the storage compartment 110, thermal transfer assembly 120, or freezer compartment 130 may include only partial insulation therebetween. In particular, in an embodiment, at least a portion of one of the storage compartment 110, thermal transfer assembly 120, or freezer compartment 130 may be in thermal contact with at least a portion of another of the storage compartment 110, thermal transfer assembly 120, or freezer compartment 130. For example, the storage compartment 110 and thermal transfer assembly 120 may include thermal insulation 181' therebetween, which may span partially along a heat transfer side 121 of the thermal transfer assembly 120. As such, a portion of the heat transfer side 121 may be in direct contact with a portion of a first side 111 of the storage compartment 110, while another portion of the heat transfer side 121 may be insulated from the storage compartment 110.

In an embodiment, the thermal transfer assembly 120 may have one or more thermally conductive walls that may define the heat transfer side 121. Also, the heat transfer side 121 may optionally include a recess 122 that may have thermal insulation 181' therein. Accordingly, a portion of the heat transfer side 121 may be separated or insulated from the first side 111 of the storage compartment 110.

In addition, for example, the thermal transfer assembly 120 may include one or more additional walls that, together with the heat transfer side 121 may form or define the perimeter of the thermal transfer assembly 120. In an embodiment, the walls collective may define an approximately rectangular perimeter. It should be appreciated that the shape and size of the thermal transfer assembly 120 may vary from one embodiment to the next. Hence, the thermal transfer assembly 120 may have a circular, triangular, polygonal, or other suitable perimeters. Accordingly, the heat transfer side of the thermal transfer assembly may have any suitable shape and may be formed by a section or a portion of a single wall or multiple walls that define a perimeter of the thermal transfer assembly.

In an embodiment, the thermal insulation 181' or the recess 122 may be positioned along a mid-portion of the heat transfer side 121. As such, opposing ends of the heat transfer side 121 may be in contact with the first side 111 of the storage compartment 110. It should be appreciated that the thermal insulation 181' may include any suitable material or structure, which may be similar to or the same as the materials or structures described above in connection with the thermal insulation 180. Furthermore, in some embodiments, the partial separation between the recess 122 of the heat transfer side 121 and the first side 111 of the storage compartment 110 may provide insulation therebetween.

As described above, in an embodiment, the storage compartment 110 may include the first side 111 that may be in thermal communication with the heat transfer side 121 of the thermal transfer assembly 120. In some embodiments, the first side 111 may include thermally conductive material. For example, the first side 111 may be formed by a thermally conductive wall.

Moreover, the perimeter of the storage compartment 110 may be at least in part defined by the first side 111. For instance, the perimeter of the storage compartment 110 may be defined collectively by the first side 111 and by additional one or more walls that may be thermally conductive or thermally insulating. In some instances, the storage compartment 110 may have an approximately rectangular perimeter. Generally, the storage compartment 110 may have any suitable shape. Also, in an embodiment, the first side 111 of the storage compartment may have a shape that corresponds with the shape of the heat transfer side 121 of thermal transfer assembly.

In any event, however, while the perimeter of the storage compartment 110 may vary from one embodiment to the next, the perimeter may in part define a volume of the storage compartment 110 that is suitable for housing temperature-sensitive materials, as described above. For example, the volume of the storage compartment 110 may be between 2 and 15 liters. Also, as described above, the first side 111 of the storage compartment 110 may be in thermal communication with at least a portion of the heat transfer side 121 of the thermal transfer assembly 120. Accordingly, removing heat and lowering the temperature in the thermal transfer assembly 120 also may remove the heat from and lower the temperature in the storage compartment 110.

Moreover, as described below in more detail, the recess 122 or the thermal insulation 181' may facilitate a substantially even temperature distribution along the first side 111 of the storage compartment 110. In other words, the recess 122 or the thermal insulation 181' may facilitate a controlled temperature selection and distribution on the first side 111 of the storage compartment 110. For example, the storage apparatus 100 may maintain the first side 111 of the storage compartment 110 at near-freezing temperature. In some embodiments, the storage apparatus 100 may maintain the first side 111 at a temperature in one or more of the following ranges: between about 8° C. and about 2° C.; about 8° C. and about 5° C.; between about 4° C. and about 2° C.; or between about 3° C. and about 0° C. In some instances, the temperature of the first side 111 of the storage compartment 110 may be less than 0° C. or greater than 8° C.

Also, the recess 122 or the thermal insulation 181' may prevent the temperature of the first side 111 from falling below a predetermined temperature (e.g., below 0° C., or below 2° C.) by at least partially impeding heat transfer from the storage compartment 110 to the thermal transfer assembly 120. In any event, the storage apparatus 100 may have a predetermined temperature or temperature range at the first side 111 of the storage compartment 110.

The temperature in the storage compartment 110 may, at least in part, depend on the temperature of the first side 111 thereof. For instance, heat in the storage compartment 110 may be transferred to the first side 111 and may be subsequently transferred to the thermal transfer assembly 120 and further removed therefrom, as described below. Accordingly, maintaining temperature of the first side 111 at predetermined level or range, such as at about 2° C., also may approximately maintain the temperature inside the storage compartment 110 at a predetermined level or within a predetermined range, which may be the same as or similar to the temperature of the first side 111.

As mentioned above, in some instances, temperature-sensitive items may require storage at near but not below freezing temperature to avoid damage or spoilage thereof. Hence, maintaining a near-freezing but not below freezing temperature may facilitate safe storage of temperature-sensitive materials in the storage compartment 110. Moreover, in some embodiments, the storage apparatus 100 may maintain the temperature inside the storage compartment 110 approximately at a predetermined level in the absence of power supply to the storage apparatus 100. For example, the thermal transfer assembly 120 may provide and maintain an approximately constant temperature or a temperature range (e.g., between 0° C. and 8° C.) for a period of at least 3 days, with ambient temperature outside of the storage apparatus at about 43° C.

Figure 2A:
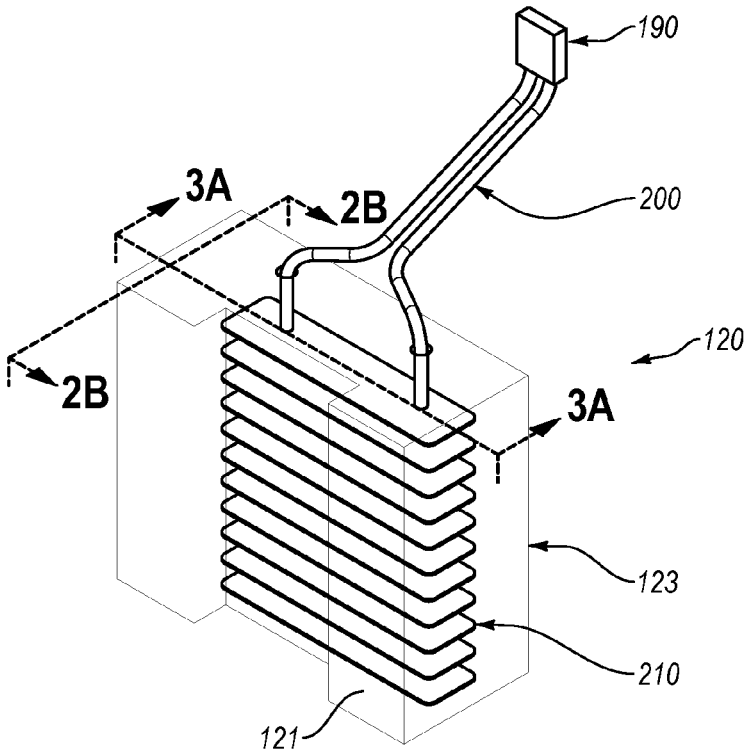
FIG. 2A is an isometric view of a thermal transfer assembly of a storage apparatus according to an embodiment.

For instance, as illustrated in FIG. 2A, the thermal transfer assembly 120 may include an enclosure 123, which may be at least partially formed by the heat transfer side 121. The enclosure 123 may house a phase change material (PCM), which may be at least partially frozen by a heat pump 190. Suitable PCM may vary from one embodiment to the next and may include water, PureTemp 1 (from Entropy Solutions, Inc.), or the like.

In some instances, the enclosure 123 may be sealed, such that the PCM may not be readily accessible (e.g., the enclosure 123 may include welded seams). Alternatively, the enclosure 123 may seal the PCM therein in a manner that removing one or more portions of the enclosure may provide access to the PCM. As such, the PCM may be added or at least partially removed or replaced.

In an embodiment, the heat pump 190 may remove heat from the PCM, thereby changing the phase of the PCM (e.g., from liquid to solid phase). Also, as the PCM is cooled, the PCM may cool the heat transfer side 121 of the thermal transfer assembly 120. It should be appreciated that the specific volume of the enclosure and of the PCM may vary from one embodiment to the next and may depend, among other things, on the size of the storage compartment, number or volume of the temperature-sensitive items stored in the storage compartment, expected ambient temperature during operation, or the like.

In some embodiments, the heat pump 190 may be in thermal communication with the PCM through one or more heat pipes, such as through heat pipes 200, which may transfer heat from the PCM to the heat pump 190. More specifically, the heat pump 190 may cool a first end of the heat pipes 200, thereby creating a temperature differential between the first end (i.e., the end coupled to the heat pump 190) and a second end, which may be positioned within the PCM.

As described below, the heat pipes 200 may transfer heat from high-temperature end thereof to the low-temperature end thereof. As such, the heat pipes 200 may transfer heat from the PCM to the heat pump 190. In turn, the heat pump 190 may maintain the first end of the heat pipes 200 at a temperature that is lower than the temperature of the second end of the heat pipes 200, thereby facilitating heat transfer from the PCM to the heat pump 190.

Also, the heat pipes 200 may include one or more bends therein, which may facilitate placing the heat pump 190 at a suitable location on the storage apparatus. For example, the heat pump 190 may be located at a back side of the storage apparatus, such that the heat pump 190 is at least partially concealed from a user of the storage apparatus. Alternatively, the heat pipes 200 may be approximately linear. In any event, the heat pipes 200 may transfer heat from the PCM to the heat pump 190.

In an embodiment, the thermal transfer assembly 120 also may include one or more fins in thermal communication with the heat pipes 200. For example, the thermal transfer assembly 120 may include a plurality of thermally conductive fins 210 attached to or in thermal communication with the heat pipes 200. The fins 210 may increase heat transfer rate from the PCM to the heat pipes 200 and to the heat pump 190. Moreover, the heat pipes 200 may facilitate directional freezing of the PCM, as described below.

The fins 210 may have any number of suitable shapes and sizes. In an embodiment, the fins 210 may be approximately planar and may have substantially flat opposing surfaces, with the fins 210 oriented substantially horizontally. Alternatively or additionally, at least some of the fins may be bent, wavelike, or may have irregular shapes. In addition, the fins 210 may include any number of suitable thermally conductive materials and combinations thereof. Examples of suitable materials for the fins 210 include, but are not limited to, aluminum, copper, or alloys thereof.

The particular heat pump 190 may vary from one embodiment to the next. In some embodiments, the heat pump 190 may be a thermoelectric heat pump, such as a Peltier cell. As described below in more detail, the thermoelectric heat pump 190 may be controlled by a controller that may be operably coupled to the heat pump 190. In any event, the heat pump 190 may remove heat from the storage compartment 110, and such heat removal may be controlled by the controller.

Figure 2B:
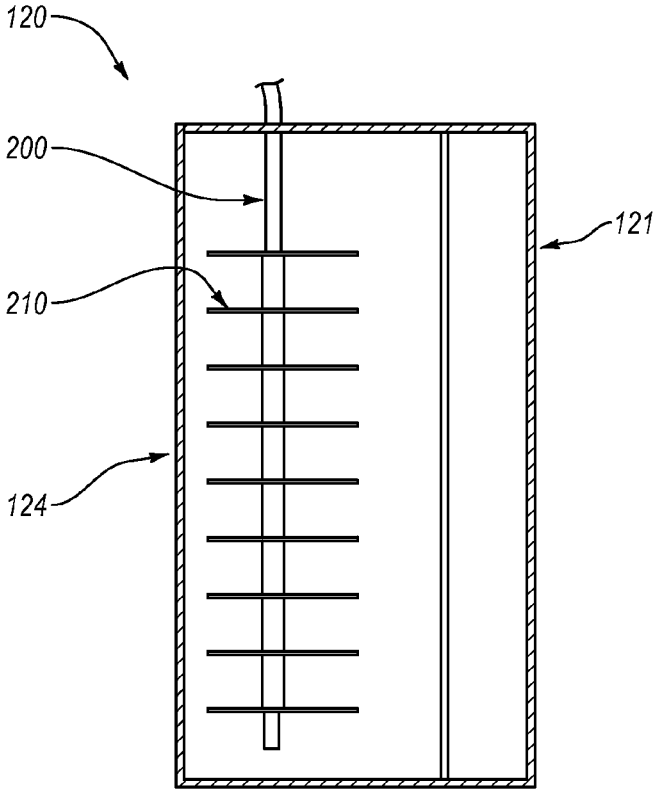
FIG. 2B is a cross-sectional view of the thermal transfer assembly of FIG. 2A.

As shown in FIG. 2B, in an embodiment, the heat pipes 200 and the fins 210 may be positioned near a back side 124 of the thermal transfer assembly 120. Hence, in some instances, the back side 124 may be cooler than the heat transfer side 121 of the thermal transfer assembly 120. For example, the back side 124 may be cooled to below freezing temperature, while the heat transfer side 121 may remain above the freezing temperature (e.g., at about 2° C.). Moreover, in an embodiment, most of the PCM may be frozen before the storage compartment reaches a predetermined temperature (e.g., 2° C.).

Figure 2C:
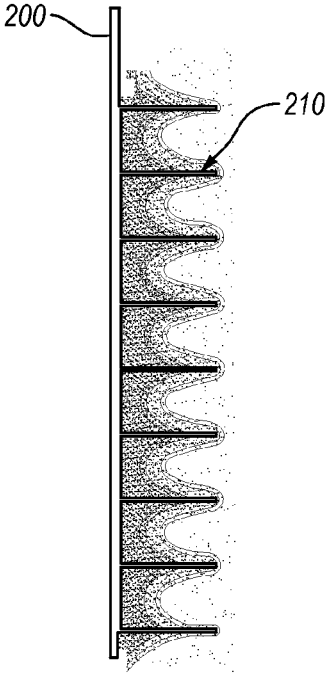
FIG. 2C is a schematic illustration of a temperature profile near a heat pipe and fins of the thermal transfer assembly of FIG. 2B.

For example, as illustrated in FIG. 2C, the temperature along the fins 210 may increase with distance from the heat pipes 200. More specifically, FIG. 2C shows a temperature gradient of the PCM surrounding the heat pipes 200, with denser stippling that indicates lower temperature zones. In an embodiment, the heat pipes 200 or the fins 210 may be positioned near the back side of the thermal heat transfer assembly. For instance, the heat pipes 200 or fins 210 may be positioned near the back side in a manner that higher temperature zones are closer to the heat transfer side of the thermal heat transfer assembly than to the back side thereof.

As described above, in some embodiments, the PCM that is closer to the heat pipes 200 may freeze. Furthermore, the PCM located father away from the heat pipes 200 may be in a different phase than the heat pipes 200 located near the heat pipes 200. For instance, the PCM farthest away from the heat pipes 200 may be in a liquid phase. In other words, the PCM near the heat transfer side 121 of the thermal transfer assembly 120 may remain near but above freezing temperature. As such, the thermal transfer assembly 120 may maintain temperature of the storage compartment at a controlled, near-freezing temperature. More specifically, heat transferred from the storage container through the heat transfer side of the thermal transfer assembly and to the PCM near the heat transfer side may be absorbed by the thermal transfer assembly by changing phase of the solid portion(s) of the PCM (e.g., from solid to liquid).

In turn, the heat pump 190 may remove heat from the PCM to maintain at least a portion of the PCM in a phase different than another portion of the PCM (e.g., to maintain most of the PCM in a solid phase). In some instances, the heat pump may continuously maintain a portion of the PCM in a changed phase, such as in a solid phase. In the absence of power from the power source, however, the heat pump may discontinue heat removal from the PCM. Accordingly, for example, the portion of the PCM that is in the solid phase may maintain the temperature of the portion of the PCM that is in a liquid phase at near-freezing by absorbing heat therefrom. In particular, absorbing heat from the PCM that is in a liquid phase may cause at least portion of the solid PCM to change phase to liquid.

In an embodiment, the heat pipes 200 and the fins 210 may facilitate directed or guided phase conversion of the PCM. For instance, the PCM may freeze in a controlled manner and in a controlled direction (e.g., relative to the heat transfer side of the thermal transfer assembly). Likewise, phase change of the solid PCM back to a liquid phase also may occur along direction(s) that are opposite to the direction(s) of freezing of the PCM. Controlled or predictable directions of phase change of the PCM may facilitate maintaining the PCM near the heat transfer side of the thermal transfer assembly at near—but not below—freezing temperature.

In some embodiments, the PCM may preferentially freeze along directions emanating from the heat pipes 200 and along the fins 210. For example, the PCM may start freezing near the heat pipes 200 (as indicated with denser stippling near the heat pipes 200, which connotes lower temperature) and proceed along a width of the fins 210 and along a width of the thermal transfer assembly, from the back side to the heat transfer side. Hence, in an embodiment, the PCM may freeze along the width of the thermal transfer assembly and in opposing directions along a length of the thermal transfer assembly. In any event, the shape, size, number, or material of the fins 210, the specifics and number of the heat pipes 200, the configuration of the heat pump 190 or power provided thereto, or combinations thereof may vary from one embodiment to the next and may be selected to at least partially control the temperature or freezing profile of the PCM in a manner that a portion of the PCM remains in a liquid phase (e.g., a portion closest to the heat transfer side of thermal transfer assembly), while another portion of the PCM is in a solid phase.

Figure 3B:
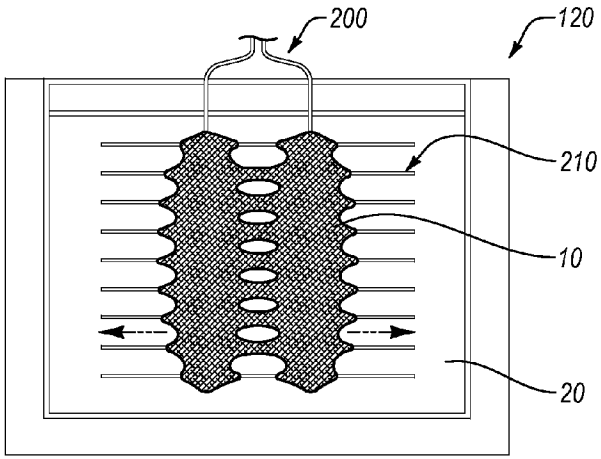
FIG. 3B is a schematic of another stage of solidification process of the phase change material in the thermal transfer assembly according to an embodiment.
Figure 3D:
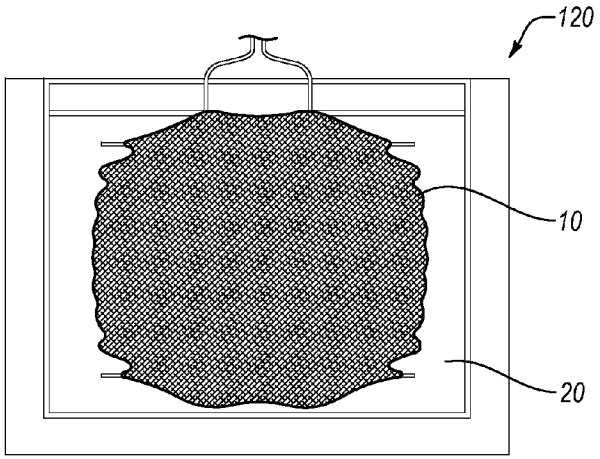
FIG. 3D is a schematic of still another stage of solidification process of the phase change material in the thermal transfer assembly according to an embodiment.
Figure 3A:
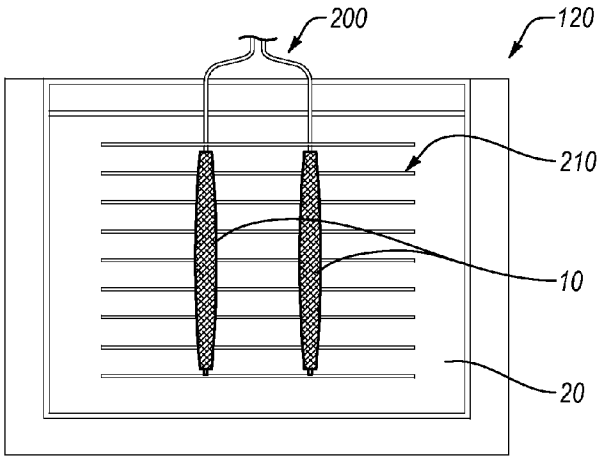
FIG. 3A is a schematic of a stage of solidification process of a phase change material in the thermal transfer assembly according to an embodiment.

FIGS. 3A-3D illustrate an embodiment of various stages of phase change of the PCM in the thermal transfer assembly 120. More specifically, FIG. 3A illustrates initial phase change of the PCM, with freezing of the PCM occurring near and about the heat pipes 200. The freezing profile of the PCM is determined by factors including the material of the fins 210 and the size, shape and relative spacing of the fins 210. For instance, the thermal transfer assembly 120 may form solid PCM 10 about the heat pipes 200, and the solid PCM 10 may extend from the heat pipes 200 along and between the fins 210 in a direction of the heat transfer side of the thermal transfer assembly 120 (as shown in FIG. 2C). It should be appreciated that at least some of the PCM may remain in an unchanged phase. For example, the thermal transfer assembly 120 may include liquid PCM 20 that may be in contact or in thermal communication with the solid PCM 10.

In some embodiments, in an initial state, all of the PCM in the thermal transfer assembly 120 may be liquid PCM 20. As the heat pump removes heat from the liquid PCM 20, the thermal transfer assembly 120 may freeze the liquid PCM 20, thereby converting the liquid PCM 20 to the solid PCM 10. In an embodiment, as shown in FIG. 3B, the liquid PCM 20 may freeze in opposite directions along the length of the thermal transfer assembly 120, as indicated by the arrows. For instance, the liquid PCM 20 may freeze near and on the fins 210 in the same or similar direction as the direction along which the fins 210 extend from the heat pipes 200. In an embodiment, the fins 210 may extend from the heat pipes 200 along the length of the thermal transfer assembly 120. Accordingly, the liquid PCM 20 may freeze along the fins 210 and in opposing directions oriented along the length of the thermal transfer assembly 120.

Figure 3C:
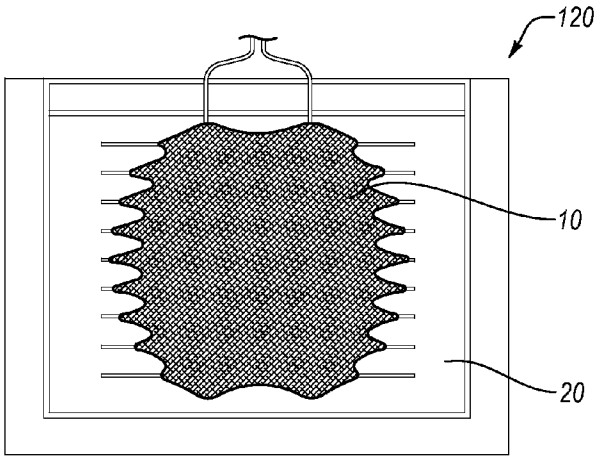
FIG. 3C is a schematic of yet another stage of solidification process of the phase change material in the thermal transfer assembly according to an embodiment.

As shown in FIGS. 3C and 3D, the liquid PCM 20 may continue to freeze along the length of the thermal transfer assembly 120, until a desired amount or volume of the solid PCM 10 is achieved in the thermal transfer assembly 120. After achieving or maintaining a desired or suitable amount of the solid PCM 10, the heat pump may at least temporarily stop removing heat from the liquid PCM 20. Moreover, as the amount of the solid PCM 10 falls below a predetermined level, the heat pump may resume removing heat from the liquid PCM 20, to reestablish a suitable level of solid PCM 10. As described below, such operation of the heat pump may be directed by the controller.

Figure 4:
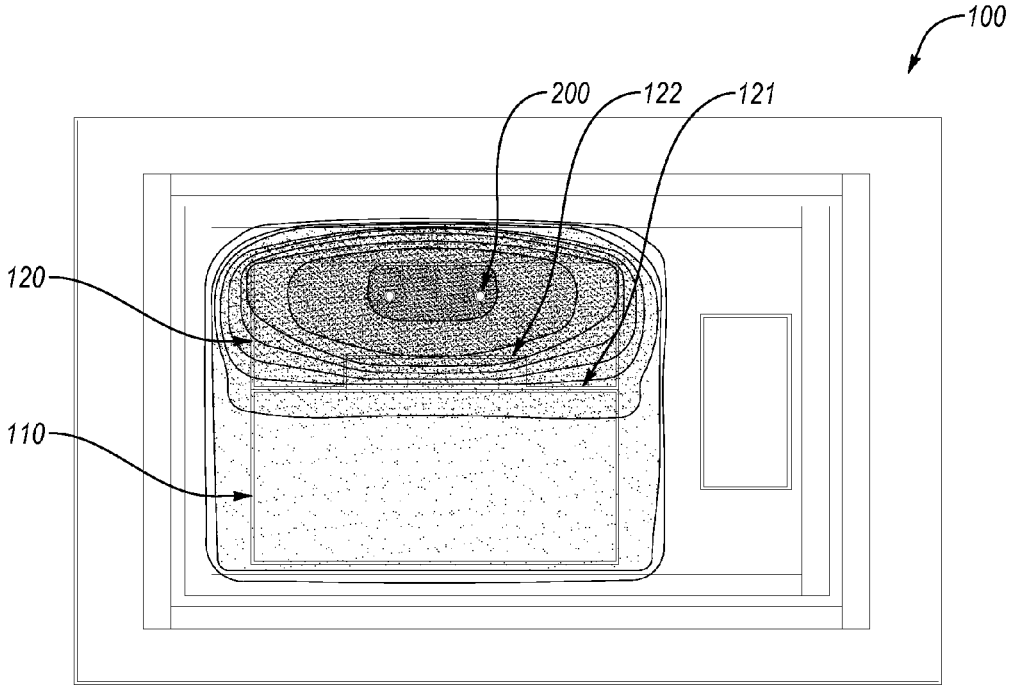
FIG. 4 is a schematic of a temperature profile in a thermal transfer assembly and in a storage compartment of a storage apparatus according to an embodiment.

In any event, the thermal transfer assembly 120 may provide a near-freezing temperature at the heat transfer side thereof, while maintaining a portion of the PCM as the solid PCM 10, thereby allowing the solid PCM 10 to absorb heat transferred to the liquid PCM 20 from the storage compartment. FIG. 4 shows an embodiment of a temperature distribution in the storage compartment 110 and in the thermal transfer assembly 120 of the storage apparatus 100—denser stippling indicates lower temperature, while lighter stippling indicates higher temperature.

As described above, liquid PCM may be in thermal communication with the solid PCM and with the heat transfer side 121 of the thermal transfer assembly 120. Furthermore, in an embodiment, the liquid PCM may have higher thermal resistance than the solid PCM. Hence, in some instances, the liquid PCM may provide at least partial insulation between the solid PCM and the heat transfer side 121 of the thermal transfer assembly 120. In any event, the liquid and solid PCM may collectively maintain an approximately constant temperature at the heat transfer side 121, which may be a near-freezing temperature (e.g., about 0° C. to 2° C.).

For example, the thermal transfer assembly 120 may have a temperature gradient formed by the PCM. In an embodiment, the PCM near the back side 124 of the thermal transfer assembly 120 may have the lowest temperature, as indicated by denser stippling. In some instances, the PCM temperature in the coldest zone may be between about 0° C. and about −3° C. Hence, for instance, if water is used as the PCM, the PCM in the coldest zone may be frozen. It should be appreciated that distinct temperature zone illustrated in FIG. 4 are shown for descriptive purposes only, such as to show an example of approximate temperature distribution within the PCM. Moreover, references to temperature "zones" are not intended to be limiting and refer to temperature of the PCM at a location in the thermal transfer assembly 120.

Conversely, the PCM near the heat transfer side 121, the PCM may have the highest temperature. As such, the PCM near the heat transfer side 121 may be in a liquid phase. In some instances, temperature distribution in the PCM may be a continuous gradient, without distinct temperature zones. In any event, in some embodiments, the PCM near the heat transfer side 121 of the thermal transfer assembly 120 may be at near freezing temperature (e.g., at about 2° C.).

Moreover, generally, temperature distribution within the PCM may vary from one embodiment to another. Temperature distribution within the PCM also may vary during operation of the storage apparatus 100. For instance, if power supply to the storage apparatus 100 is interrupted and the heat pump stops removing heat from the PCM, temperature distribution within the PCM may change. For example, during operation of the heat pump temperature distribution in the PCM may be from the lowest, such as about −3° C. to highest, such as near-freezing temperature (e.g., about 2° C.). If the heat pump stops operating, the lowest temperature in the PCM may change or temperature distribution also may change, such that coldest PCM represents a smaller portion (as compared with the distribution during operation of the heat pump).

In any case, the temperature near the heat transfer side 121 may remain approximately unchanged after the heat pump stops working. In particular, the temperature of the PCM near heat transfer side 121 may stay approximately at a near-freezing temperature for a period of 1 to 3 days. For example, while the heat pump is not removing heat from the PCM, heat absorbed by the PCM near the heat transfer side 121 may be transferred to the colder PCM located farther away from the heat transfer side 121. As such, the colder zones of the PCM may absorb heat from the zones near the heat transfer side 121 and may maintain the zones near the heat transfer side 121 at near-freezing temperature. Accordingly, the thermal transfer assembly 120 may maintain near-freezing temperature in the storage compartment 110 with interruption of power supply.

In some instances, a greater amount of PCM may freeze near a portion of the thermal transfer assembly 120. For example, as described above, the thermal transfer assembly 120 may include two heat pipes 200. Moreover, in some embodiments, the PCM may exhibit greater phase change at a location between the heat pipes 200. For instance, the solid PCM may form a peak or a dome aligned approximately at a center point between the heat pipes 200. Also, the solid PCM may be closer to the heat transfer side 121 at the peak of the dome than at other locations in the thermal transfer assembly 120. In an embodiment, the thermal transfer assembly 120 may include the recess 122, which may provide additional insulation between the heat transfer side 121 and the storage compartment 110 at location(s) where the solid PCM is unevenly close to the heat transfer side 121, such as near the peak of the dome formed by the solid PCM.

The width and depth of the recess 122 (i.e., distance from the heat transfer side 121) may vary from one embodiment to another and may depend, among other things, on temperature distribution in the PCM, location of the dome or peak of the solid phase PCM, type of insulation used in the recess 122 (e.g., using polyurethane foam in the 122 may reduce the thickness thereof as compared with using air). In any event, the depth, length, and insulation material included in the 122 may be chosen in a manner that provides an approximately constant temperature distribution across the interface between the heat transfer side 121 and the storage compartment 110 (e.g., near-freezing temperature).

Figure 5A:
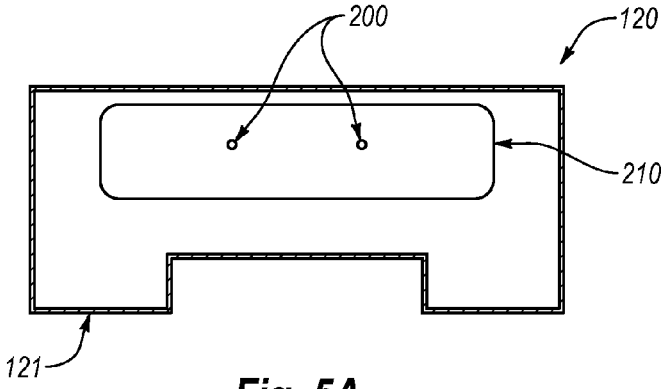
FIG. 5A is a top, cross-sectional view of a thermal transfer assembly according to an embodiment.

Moreover, as described above, in some embodiments, the heat pipes 200 may include one or more fins, which may promote phase conversion or freezing/thawing of the PCM along one or more predetermined directions within the thermal transfer assembly 120. In an embodiment, as illustrated in FIG. 5A, the thermal transfer assembly 120 may include the fins 210 that may have approximately rectangular shapes. Moreover, the heat pipes 200 or the fins 210 may be positioned near the back side 124 (as compared with the position of the heat pipes 200 and the fins 210 relative to the heat transfer side 121). Accordingly, the thermal transfer assembly 120 may produce temperature distribution described above.

Also, the heat pipes 200 or the fins 210 may be approximately centered relative to the length of the thermal transfer assembly 120. For example, ends of the fins 210 may be spaced by approximately the same distances from the opposing sides of the thermal transfer assembly 120. Hence, in some instances, the PCM may remain in the liquid phase between the ends of the fins 210 and the sides of the thermal transfer assembly 120. Moreover, as described above, more of the PCM may change to solid phase at a location between the heat pipes 200, thereby forming a dome or a peak, which may be closer to the heat transfer side 121 than other portions of solid PCM. In some embodiments, however, the fins may have a non-rectangular shape, which may at least partially compensate for such freezing of the PCM, thereby forming solid phase PCM that terminates at approximately the same distance from the heat transfer side 121.

Figure 5B:
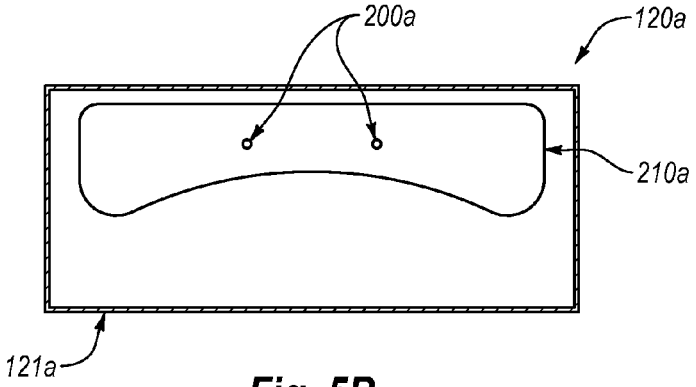
FIG. 5B is a top, cross-sectional view of a thermal transfer assembly according to another embodiment.

For example, FIG. 5B illustrates a thermal transfer assembly 120*a* that may include non-rectangular fins 210*a*. Except as otherwise described herein, the thermal transfer assembly 120*a* and its materials, elements, and components may be similar to or the same as the thermal transfer assembly 120 (FIGS. 1B-4) and its respective materials, elements, and components. For instance, the thermal transfer assembly 120*a* may include heat pipes 200*a* in thermal communication with the thermal transfer assembly 120*a*, which may be similar to or the same as heat pipes 200 (FIGS. 1B-4). In an embodiment, the thermal transfer assembly 120*a* includes fins 210*a* that have a curved or arcuate front side (i.e., side of the fins 210*a* that faces the heat transfer side 121*a*). More specifically, the fins 210*a* may have a concave front side.

Concave configuration of the front side of the fins 210*a* may produce solid phase PCM that is offset at approximately the same distance from the heat transfer side 121*a* along the length of the thermal transfer assembly 120*a*. As such, the heat transfer side 121*a* of the thermal transfer assembly 120*a* may have no recess. Maintaining approximately the same distance from the heat transfer side 121*a* to the solid phase PCM may also facilitate approximately constant temperature along the heat transfer side 121*a* (e.g., near-freezing temperature). In addition, eliminating the recess from the heat transfer side 121*a* may allow the thermal transfer assembly 120*a* to include a greater amount of PCM (as compared with the thermal transfer assembly that has a recess). Consequently, the thermal transfer assembly 120*a* may maintain near-freezing temperature in the storage compartment for a longer duration during inactivity of the heat pump, as compared with the thermal transfer assembly that includes a recess.

Figure 6A:
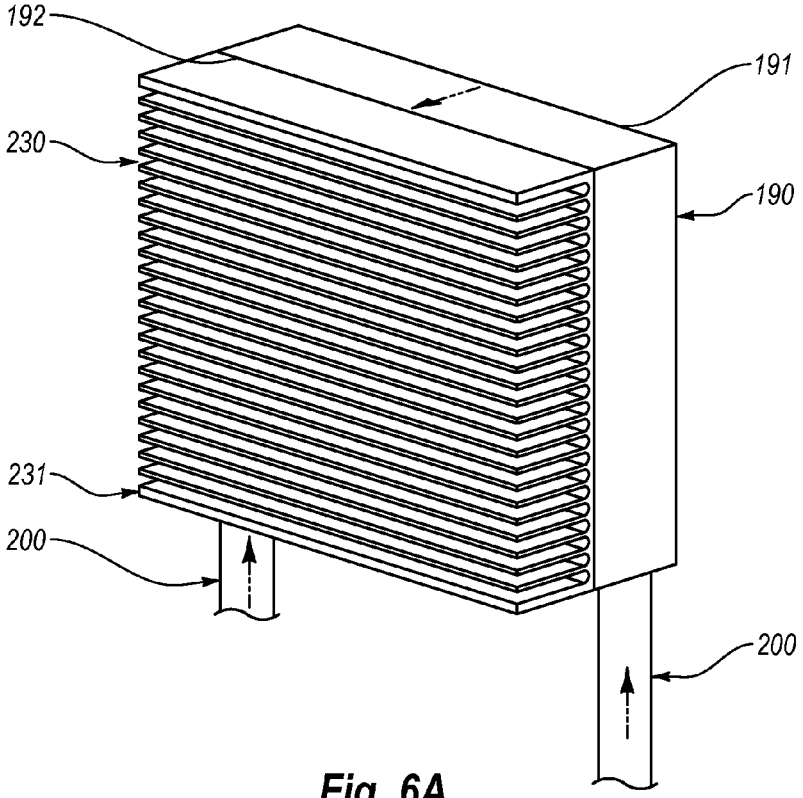
FIG. 6A is an isometric view of a heat pump with a heat sink of a storage apparatus according to an embodiment.

As described above, in an embodiment, the storage apparatus may include a thermoelectric heat pump. FIG. 6A illustrates an embodiment of a suitable configuration for a thermoelectric heat pump 190. More specifically, as shown in FIG. 6A, the thermoelectric heat pump 190 may produce heat flow from a cold side 191 to a hot side 192 thereof. Consequently, placing first ends of the heat pipes 200 in thermal communication within the cold side 191 of the thermoelectric heat pump 190 may cool the first ends of the heat pipes 200. As described above, the second ends or portions of the heat pipes 200 may be positioned in and may be in thermal communication with the PCM. Accordingly, cooling the first ends of the heat pipes 200 may produce heat flow along the heat pipes 200 form the PCM and toward the first ends of the heat pipes 200, where the heat may be further transferred to the cold side 191 and may be urged to flow from the cold side 191 to the hot side 192 (as indicated with the arrows) by applying a voltage across the thermoelectric heat pump 190.

In an embodiment, a heat sink may be attached to the thermoelectric heat pump 190, which may aid heat dissipation from the hot side 192 of the thermoelectric heat pump 190 (e.g., to the ambient environment). The particular configuration of the heat sink may vary from one embodiment to another. Generally, the heat sink may increase surface area exposed to a cooling medium, such as ambient air, as compared with a flat surface of the hot side 192. Accordingly, the heat sink may improve conductive and convective heat transfer from the hot side 192, thereby improving efficiency of the thermoelectric heat pump 190.

For instance, a heat sink 230 may be in thermal communication with the hot side 192 and may include multiple linear ribs 231 that may span from a first edge of the hot side 192 to a second edge thereof. As noted above, however, the heat sink may have other configurations and may include nonlinear ribs, posts, other protrusions, or combinations thereof. In any event, the heat sink may increase heat transfer from the hot side 192, thereby cooling the hot side 192 of the thermoelectric heat pump 190.

Figure 6B:
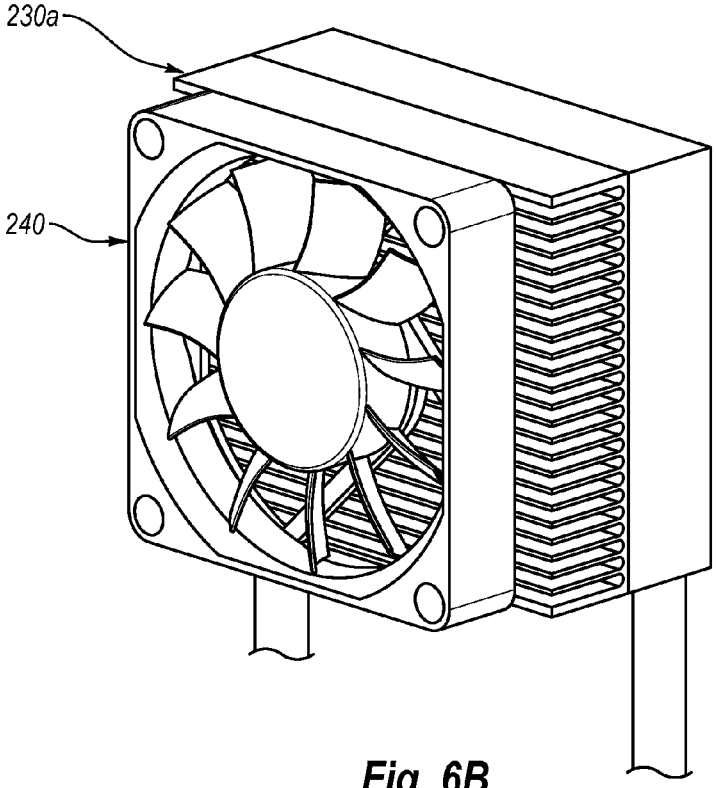
FIG. 6B is an isometric view of a heat pump with a heat sink of a storage apparatus according to another embodiment.

In an embodiment, a cooling medium may be urged toward or into the heat sink to improve convective heat transfer therefrom. For example, as illustrated in FIG. 6B, a fan 240 may provide air flow to or through a heat sink 230*a*. In some instances, the fan 240 may be attached to the heat sink 230*a*. Alternatively or additionally, the fan 240 may be attached to an outer shell of the storage apparatus or another portion thereof. In any case, the fan 240 may urge cooling medium toward the heat sink 230*a*, thereby increasing convective heat transfer therefrom.

Figure 7:
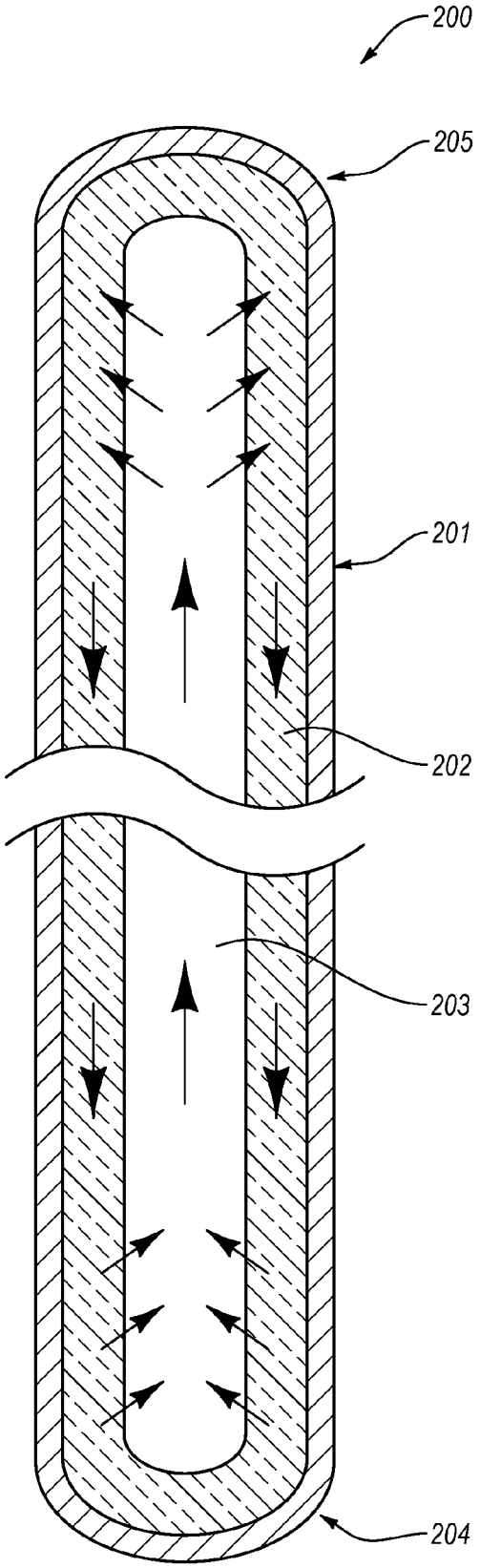
FIG. 7 is a cross-sectional view of a heat pipe of a storage apparatus according to an embodiment.

The number, arrangement, and configuration of heat pipes may vary from one embodiment to the next. Generally, however, as illustrated in FIG. 7, the heat pipe 200 may include an outer shell 201, a wick 202 positioned within the outer shell 201, and a vapor cavity 203 defined by the wick 202. In some instances, the outer shell 201 may include stainless steel, copper, or other suitable thermally conductive material of sufficient strength.

The heat pipes 200 also may include a working fluid or coolant that may evaporate upon absorption of heat at a hot end 204 of the heat pipe 200. Suitable working fluids may vary from one embodiment to the next and may depend, among other things, on the operating temperatures of the heat pipe 200 at the hot end 204 and at a cold end 205 thereof as well as on the pressure in the heat pipes 200. Examples of working fluid include water, methanol, ethanol, ammonia, anhydrous ammonia, propylene, etc. In some embodiments, the heat pipe 200 may include ammonia or methanol.

In any case, as the working fluid at the hot end 204 absorbs heat from the PCM, which may be at about 0° C., the working fluid may evaporate, enter the vapor cavity 203, and may move inside the vapor cavity 203 toward the cold end 205, as indicated by the arrows. When the vapor reaches the cold end 205 (i.e., the end cooled by the heat pump), the vapor may be condensed to liquid and may be wicked into the wick 202, as shown by the arrows. Subsequently, the liquefied working fluid may move back toward the hot end 204 (e.g., under force of gravity, under capillary force, etc.). In addition, such operation of the heat pipe 200 may be repeated in a cycle, thereby continuously removing heat from the PCM and transferring the removed heat to the heat pump.

While in the illustrated embodiment the storage apparatus includes at least one heat pipe, it should be appreciated that the storage apparatus may include any number of heat pipes or no heat pipes. For example, the heat pump may be in direct thermal communication with the PCM. Also, in some embodiments, any suitable thermally conductive material or structure may provide thermal communication between the heat pump and the PCM. In any case, operation of the heat pump may remove heat from the PCM, thereby changing phase of at least a portion of the PCM (e.g., from liquid to solid).

Figure 8A:
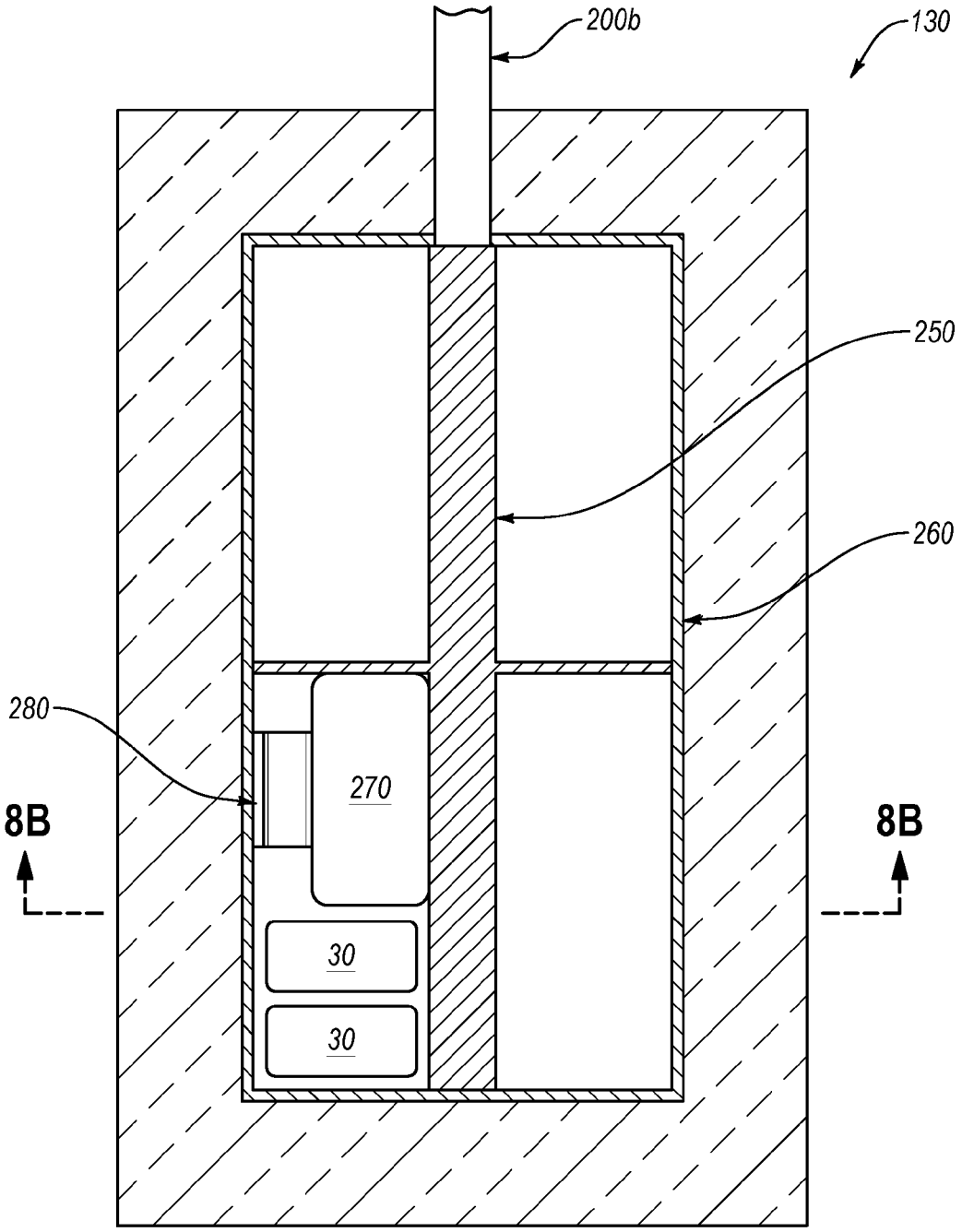
FIG. 8A is a top, cross-sectional view of a freezer compartment of a storage apparatus according to an embodiment.
Figure 8B:
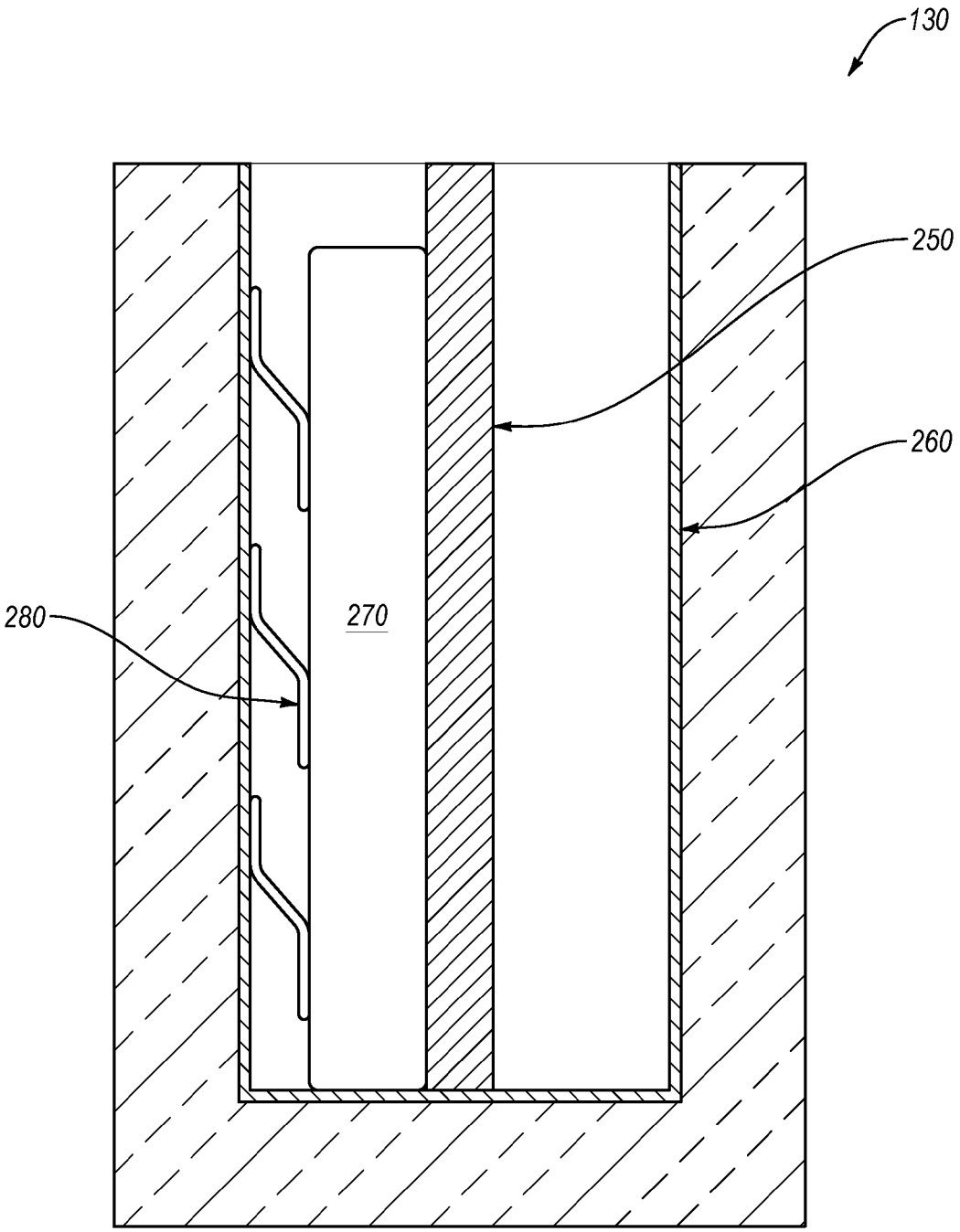
FIG. 8B is a side cross-sectional view of the freezer compartment of FIG. 8A.

As described above, in some embodiments, the storage apparatus may include a freezer compartment, which may produce temperature below 0° C., sufficient to freeze water in the items stored in the freezer compartment. In an embodiment, a freezer compartment is configured to freeze blocks of ice. FIGS. 8A-8B illustrate an embodiment of the freezer compartment 130. In particular, FIG. 8A shows that the freezer compartment 130 may include at least one heat pipe 200*b* in thermal communication with fins or plates 250. The heat pipe 200*b* may be the similar to or the same as any of the heat pipes 200, heat pipes 200*a* (FIGS. 2A-7).

In some embodiments, the plates 250 may form or define walls or dividers within the freezer compartment 130. For example, the freezer compartment 130 may include one or more walls that may form a container 260, which may define the storage volume of the freezer compartment. The plates 250 may divide the volume defined by the container 260 into multiple sections or segments. In an embodiment, the plates 250 may divide the container 260 into four quadrants, each of which may store one or more temperature-sensitive items or materials 30.

Moreover, in some instances, the plates 250 also may be in thermal communication with the container 260. It should be appreciated that the plates 250 or the container 260 may include thermally conductive materials, which may increase the heat transfer area from the volume of the freezer compartment 130 to the heat pipe 200*b*. In other words, in an embodiment, the plates 250 or container 260 may operate similar to or the same as the fins 210 (e.g., FIG. 2A).

Also, the freezer compartment 130 may include a heat pump in thermal communication with the heat pipe 200*b*. The heat pump of the freezer compartment 130 may be similar to or the same as the heat pump 190 (FIG. 2A). In any event, the heat pump may cool a first end of the heat pipe 200*b*, thereby producing a temperature differential between the first and second ends of the heat pipe 200*b* and facilitating heat transfer from the freezer compartment 130 to the heat pump. As noted above, the heat pump may further transfer heat from a cold side thereof to a hot side thereof—subsequently, the heat on the hot side of the heat pump may be transferred to a cooling medium, such ambient air.

The freezer compartment 130 may be a dry compartment. In an embodiment, the freezer compartment 130 may include no PCM. Moreover, the freezer compartment 130 may control temperature of the temperature-sensitive items 30 at least in part by freezing one or more freezable packs, such as ice pack 270. For example, ice pack 270 may include a freezable material encased in a shell (e.g., water encased in a plastic shell).

In some embodiments, the freezer compartment 130 may freeze the freezable material in the ice pack 270. Hence, when the heat pump is not operating, the frozen ice packs 270 may maintain suitable temperature in the freezer compartment 130, such as temperature below 0° C. That is, the frozen ice pack 270 may absorb energy from the volume of the freezer compartment 130 to melt the frozen material thereof, thereby maintaining the temperature in the freezer compartment 130 below freezing.

In additional or alternative embodiments, the freezer compartment 130 may be surrounded by PCM. In other words, the storage apparatus may include a chamber or a channel that surrounds the freezer compartment 130, and which includes PCM. The PCM in such chamber may be frozen (e.g., via operation of heat pump as described above), and may further facilitate maintaining a below freezing temperature in the freezer compartment 130.

In some embodiments, the ice pack 270 may be pressed against the plates 250 or container 260 to increase surface-to-surface contact therebetween and facilitate conductive heat transfer therebetween. For example, the freezer compartment 130 may include one or more clips 280 or other urging mechanism that may press the ice pack 270 against the plates 250. More specifically, in an embodiment, two sides of the ice packs 270 may be pressed against the plates 250.

Moreover, as illustrated in FIG. 8B, the clips 280 may press the ice pack 270 against the plate 250 along some, most, or all of the height thereof. In other words, the freezer compartment 130 may include multiple clips 280 positioned at various heights within the container 260. In some instances, the clips 280 may be positioned at different heights along one or more walls that define the container 260. As such, in an embodiment, at least one face of the ice pack 270 may be pressed against the plate 250.

The clip 280 may have any number of suitable configurations. For instance, the clip 280 may include compliant and sufficiently rigid or spring-like material, which may flex and press against a side of the ice pack 270, thereby urging the ice pack 270 toward and against the plate 250. As such, the ice pack 270 may be removed or replaced easily and without disassembly or unfastening of any elements or components of the freezer compartment 130. Additionally or alternatively, the ice pack 270 may be pressed against the plate 250 or container 260 with one or more fasteners, buckles, latches, or the like. In any event, some embodiments may include ice pack 270 pressed against the plate 250 or container 260.

Figure 9:
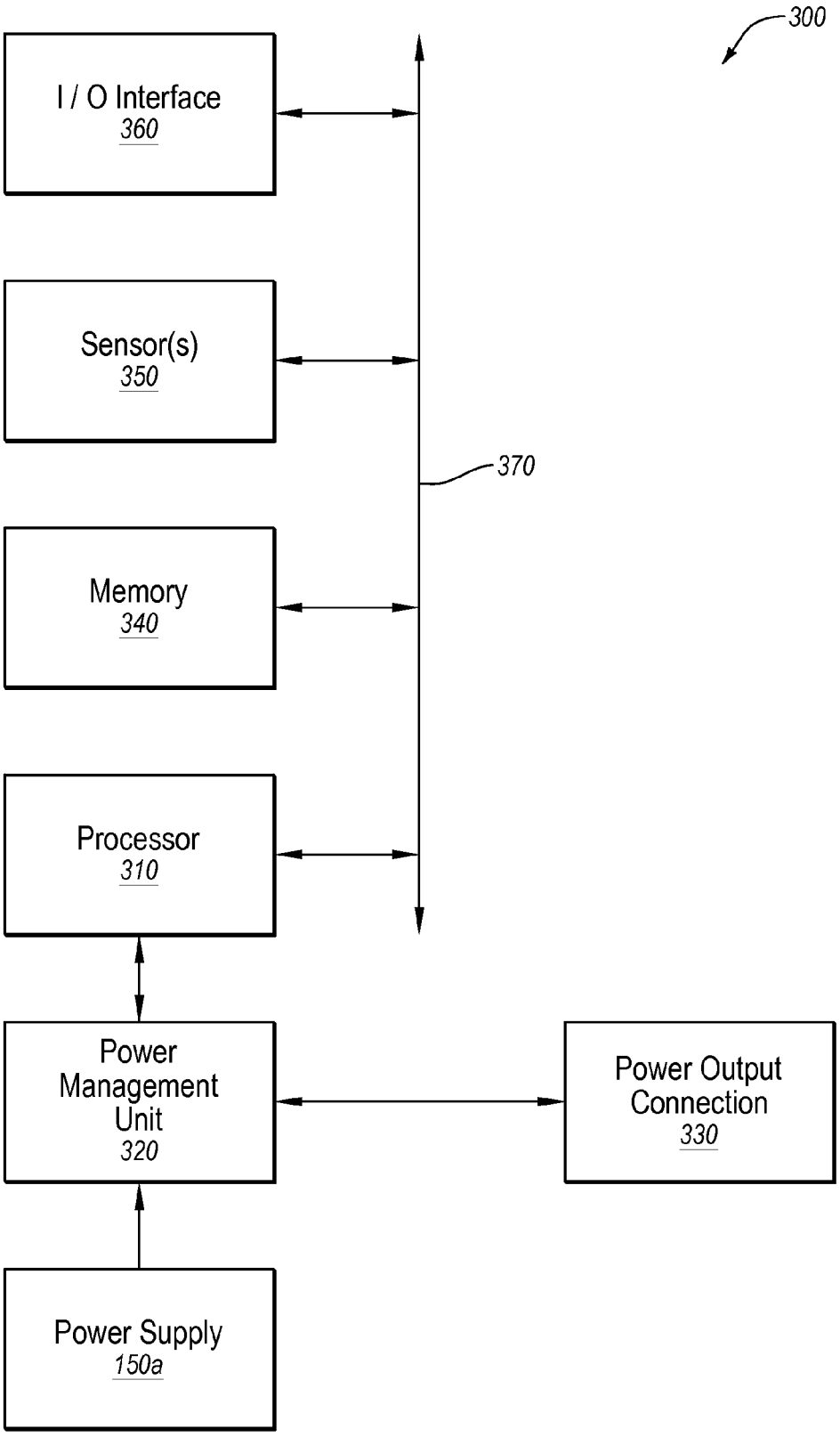
FIG. 9 is a block diagram of a controller of a storage apparatus according to an embodiment.

As described above, the storage apparatus may control the temperature in the storage or in the freezer compartments by controlling operation of the one or more heat pump associated therewith. FIG. 9 illustrates a block diagram of a controller 300 of the storage apparatus according to an embodiment. For instance, the controller 300 may include at least one processor 310 coupled to a power source 150*a* (e.g., a solar panel) and to a power management unit 320. The processor 310 may direct the power management unit 320 to provide power to a power output connection 330.

For instance, a heat pump may be connected at power output connection 330. The processor 310 may direct the power management unit 320 to supply power to the power output connection 330 and to the heat pump. As such, by controlling whether the heat pump operates or voltage provided to the heat pump, the processor 310 may control the temperature in the thermal transfer assembly or in the freezer compartment. In other words, for example, the controller may direct the heat pump to remove heat from the PCM until a predetermined portion of the PCM is at a suitable temperature or is in a solid phase. Consequently, the processor 310 also may control the temperature in the storage compartment (e.g., the processor 310 may control the temperature in the storage compartment to within about ±1° C.).

The processor 310 and the power management unit 320 also may adjust or transform the power received from the power source 150*a* to a suitable voltage or, for example, may convert the power to direct current. For instance, as described above, the power source 150*a* may include a solar panel. In some operating conditions, the output voltage from the solar panel may vary (e.g., due to variance in exposure to light). The processor 310 and the power management unit 320 may convert the power received from the solar panel to a suitable voltage, which may be further supplied to other elements or components of the storage apparatus, such as to the controller 300 and to the heat pump, among others. In other words, the controller 300 may be programmed to receive varying or variable voltage from the power source and to regulate such voltage to further provide suitable voltage to the heat pump.

In an embodiment, the power output connection 330 may be coupled to a memory 340, which may contain operating instructions for the power output connection 330. Specifically, in an embodiment, the memory 340 may include instructions about desirable temperature or temperature distribution in the PCM in the thermal transfer assembly. For example, the memory 340 may include instructions that relate change in volume of the PCM in the thermal transfer assembly to a suitable temperature distribution therein.

For instance, the PCM may include water. As PCM changes phase from liquid to solid, the total volume of the PCM in the thermal transfer assembly may change. Furthermore, the initial volume of the PCM (e.g., when all of the PCM is in a liquid phase) may be known or stored in the memory 340. Accordingly, the processor may receive information about the volume (e.g., from one or more sensors) of the PCM and may calculate change in volume. Moreover, the processor 310 may calculate the amount of solid phase PCM. Hence, the instructions stored in the memory 340 may allow the processor 310 to determine the amount of solid phase PCM or temperature distribution in the thermal transfer assembly.

In additional or alternative embodiments, the instructions stored in the memory 340 also may allow the processor 310 to use one or more temperature readings from the PCM to control operation of the heat pump. For instance, the processor 310 may receive a single or multiple temperature readings (e.g., from sensors) indicative of the temperature in one or more zones in the PCM. When the temperature in the predetermined one or more zone in the PCM is at a predetermined level, as set in the instructions in the memory 340, the processor 310 may stop operation of the heat pump.

In any case, the memory 340 may include instructions that may allow the processor 310 to determine whether to direct power management unit 320 to supply power to the heat pump connected at power output connection 330, thereby controlling the temperature in the thermal transfer assembly and, thus, in the storage compartment. In an embodiment, the processor 310 may include similar instructions for operating the heat pump of the freezer compartment. For instance, the processor 310 may maintain operation of the freezer compartment heat pump until reaching a predetermined temperature level (e.g., −3° C.).

The memory 340 also may include instructions regarding priority or hierarchy of power needs. In other words, when the power received from the power source 150*a* is insufficient to power all elements or components connected at the power output connection 330, the processor 310 may use the priority instructions to direct the power management unit 320 to provide power to elements or components indicated as having priority over other elements or components. For instance, processor 310 may give priority to providing power to the controller 300 over heat pump, and to the heat pump of the thermal transfer assembly over the heat pump of the freezer compartment. In an embodiment, the priority hierarchy may be as follows, listed from highest to lowest: controller 300 (or batter attached to the controller 300, if any); heat pump of the thermal transfer assembly, fan for the heat sink of the heat pump (if any); heat pump of the freezer compartment; auxiliary power supply port.

Also, as described above, the storage apparatus may include an auxiliary power supply port, such as a USB port. The memory 340 may include priority instructions that may disable the auxiliary power supply port (at least temporarily) to facilitate operation of one or more heat pumps. Additionally, the memory 340 may include instructions for the processor 310 that may allow the processor 310 to direct the power management unit 320 to supply excess power, produced or otherwise available from the power source, to the auxiliary power supply port.

It should be appreciated that the supply of power to the controller 300 may include one or more batteries. In an embodiment, the battery may be a rechargeable battery and may power only the controller 300 (e.g., processor 310, power management unit 320, memory 340, etc.). Hence, as mentioned above, when the controller 300 is operating only on such battery, the processor 310 may direct the power management unit 320 to prioritize power supply to the controller 300 before providing any power to other elements or components. In an embodiment, the storage apparatus may include one or more rechargeable batteries that may also provide sufficient power to operate one or more heat pumps. The processor 310 may direct the power management unit 320 to distribute power to such rechargeable batteries for charging as well as to distribute power therefrom for operation of various elements or components of the storage apparatus.

To receive information about the temperature or volume levels described above, the processor 310 may be coupled to one or more sensors 350. For instance, the sensors 350 may include thermocouples (e.g., a temperature sensor), volumetric sensors, or the like. Moreover, in some instances, the processor 310 may store or log temperature or volume readings in the memory 340. In additional or alternative embodiments, the controller 300 may include one or more I/O interface 360 coupled to the processor 310. More specifically, the I/O interface 360 may provide information about operation of the storage apparatus or may allow programming of instructions to the memory 340. For example, the controller 300 may be programmed to vary the predetermined voltage responsive a temperature of one or more of the storage compartment 110, thermal transfer assembly 120, or the freezer compartment 130.

As described above, for example, the storage apparatus may include one or more displays. In an embodiment, I/O interface 360 may include such temperature displays. For instance, the processor 310 may direct the I/O interface 360 (temperature displays) to display temperature readings from the storage compartment, freezer compartment, PCM, or combinations thereof. In an example, such readings may be obtained by the sensors 350. It should be appreciated that in additional or alternative embodiments, temperature displays may be unconnected to the processor 310 and may display readings directly from one or more sensor (or may be analog displays).

In an embodiment, a user or a manufacturer may provide and store instructions in the memory 340 of the controller 300. For instance, such instructions may be provided through an input device (e.g., a keyboard) via the I/O interface 360. In some embodiments, however, the controller 300 may be configured not to accept instructions from the user. More specifically, the controller 300 (e.g., the memory 340) may not accept programming or other instructions, such as to avoid user errors that may be introduced with such instructions.

In an embodiment, a Bus 370 may couple the I/O interface 360, sensors 350, memory 340, or combinations thereof to the processor 310. Hence, in an embodiment, the processor 310 may simultaneously communicate with one or more of the I/O interface 360, sensors 350, or memory 340. Furthermore, it should be appreciated that any of the processor 310, power management unit 320, power output connection 330, memory 340, sensors 350, I/O interface 360, or combinations thereof may be embodied in a single component or element included in the controller 300.

The reader will recognize that the state of the art has progressed to the point where there is little distinction left between hardware and software implementations of aspects of systems; the use of hardware or software is generally (but not always, in that in certain contexts the choice between hardware and software can become significant) a design choice representing cost vs. efficiency tradeoffs. The reader will appreciate that there are various vehicles by which processes and/or systems and/or other technologies described herein can be effected (e.g., hardware, software, and/or firmware), and that the preferred vehicle will vary with the context in which the processes and/or systems and/or other technologies are deployed. For example, if an implementer determines that speed and accuracy are paramount, the implementer may opt for a mainly hardware and/or firmware vehicle; alternatively, if flexibility is paramount, the implementer may opt for a mainly software implementation; or, yet again alternatively, the implementer may opt for some combination of hardware, software, and/or firmware. Hence, there are several possible vehicles by which the processes and/or devices and/or other technologies described herein may be effected, none of which is inherently superior to the other in that any vehicle to be utilized is a choice dependent upon the context in which the vehicle will be deployed and the specific concerns (e.g., speed, flexibility, or predictability) of the implementer, any of which may vary. The reader will recognize that optical aspects of implementations will typically employ optically-oriented hardware, software, and or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of skill in the art in light of this disclosure. In addition, the reader will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link, etc.).

In a general sense, the various embodiments described herein can be implemented, individually and/or collectively, by various types of electro-mechanical systems having a wide range of electrical components such as hardware, software, firmware, or virtually any combination thereof; and a wide range of components that may impart mechanical force or motion such as rigid bodies, spring or torsional bodies, hydraulics, and electro-magnetically actuated devices, or virtually any combination thereof. Consequently, as used herein "electro-mechanical system" includes, but is not limited to, electrical circuitry operably coupled with a transducer (e.g., an actuator, a motor, a piezoelectric crystal, etc.), electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of random access memory), electrical circuitry forming a communications device (e.g., a modem, communications switch, or optical-electrical equipment), and any non-electrical analog thereto, such as optical or other analogs. Those skilled in the art will also appreciate that examples of electro-mechanical systems include but are not limited to a variety of consumer electronics systems, as well as other systems such as motorized transport systems, factory automation systems, security systems, and communication/computing systems. Those skilled in the art will recognize that electro-mechanical as used herein is not necessarily limited to a system that has both electrical and mechanical actuation except as context may dictate otherwise.

In a general sense, the various aspects described herein which can be implemented, individually and/or collectively, by a wide range of hardware, software, firmware, or any combination thereof can be viewed as being composed of various types of "electrical circuitry." Consequently, as used herein "electrical circuitry" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of random access memory), and/or electrical circuitry forming a communications device (e.g., a modem, communications switch, or optical-electrical equipment). The subject matter described herein may be implemented in an analog or digital fashion or some combination thereof.

The herein described components (e.g., steps), devices, and objects and the discussion accompanying them are used as examples for the sake of conceptual clarity. Consequently, as used herein, the specific exemplars set forth and the accompanying discussion are intended to be representative of their more general classes. In general, use of any specific exemplar herein is also intended to be representative of its class, and the non-inclusion of such specific components (e.g., steps), devices, and objects herein should not be taken as indicating that limitation is desired.

With respect to the use of substantially any plural and/or singular terms herein, the reader can translate from the plural to the singular and/or from the singular to the plural as is appropriate to the context and/or application. The various singular/plural permutations are not expressly set forth herein for sake of clarity.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components and/or wirelessly interactable and/or wirelessly interacting components and/or logically interacting and/or logically interactable components.

In some instances, one or more components may be referred to herein as "configured to." The reader will recognize that "configured to" can generally encompass active-state components and/or inactive-state components and/or standby-state components, unless context requires otherwise.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. Furthermore, it is to be understood that the invention is defined by the appended claims. In general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense the convention (e.g., "a system having at least one of A, B, or C" would include but not be limited to systems that have A alone, B alone, C alone, A and B together, A and C together, B and C together, and/or A, B, and C together, etc.). Virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

With respect to the appended claims, the recited operations therein may generally be performed in any order. Examples of such alternate orderings may include overlapping, interleaved, interrupted, reordered, incremental, preparatory, supplemental, simultaneous, reverse, or other variant orderings, unless context dictates otherwise. With respect to context, even terms like "responsive to," "related to," or other past-tense adjectives are generally not intended to exclude such variants, unless context dictates otherwise.

While various aspects and embodiments have been disclosed herein, the various aspects and embodiments disclosed herein are for purposes of illustration and are not intended to be limiting, with the true scope and spirit being indicated by the following claims.

What is claimed is:

1. A storage apparatus for storing at least one temperature-sensitive material at a controlled temperature, the storage apparatus comprising:

an enclosure structure including, a storage compartment configured to hold the at least one temperature-sensitive material;

a thermal transfer assembly adjacent to and in thermal communication with the storage compartment, the thermal transfer assembly including, a phase change material;

one or more heat pipes positioned at least partially within the phase change material, the one or more heat pipes including one or more exterior surfaces at least partially surrounded by the phase change material; and a plurality of thermally conductive fins in thermal communication with the one or more heat pipes and positioned at least partially within the phase change material;

a thermoelectric heat pump in thermal communication with the one or more heat pipes;

a heat sink in thermal communication with the thermoelectric heat pump;

at least one temperature sensor configured to measure temperature in at least one of the storage compartment or the thermal transfer assembly; and a controller operably coupled to the thermoelectric heat pump and to the at least one temperature sensor, the controller being configured to direct the thermoelectric heat pump to controllably cool the phase change material so that a temperature of the storage compartment is controlled responsive to information from the at least one temperature sensor.

2. The storage apparatus of claim 1, wherein the storage compartment is at least partially defined by at least one first wall and at least one second wall that separates the storage compartment from the thermal transfer assembly, the at least one first wall has a first thermal conductivity and the at least one second wall has a second thermal conductivity that is higher than the first thermal conductivity.

3. The storage apparatus of claim 2, wherein the at least one first wall has thermal conductivity of less than about 0.3 W/(m×K).

4. The storage apparatus of claim 2, wherein the at least one first wall includes a vacuum chamber.

5. The storage apparatus of claim 2, wherein the at least one first wall includes aerogel.

6. The storage apparatus of claim 2, wherein the thermal transfer assembly includes one or more third walls having the first thermal conductivity.

7. The storage apparatus of claim 1, further comprising a lid sized and configured to cover one or more of the storage compartment or the thermal transfer assembly.

8. The storage apparatus of claim 1, wherein the plurality of thermally conductive fins are oriented substantially horizontally.

9. The storage apparatus of claim 8, wherein at least one of a size, shape, or material of the plurality of thermally conductive fins or the one or more heat pipes are selected to partially control a freezing profile of the phase change material so that a portion of the phase change material adjacent to the storage compartment is not frozen.

10. The storage apparatus of claim 1, wherein the one or more heat pipes are spaced away from at least one wall that separates the thermal transfer assembly from the storage compartment.

11. The storage apparatus of claim 1, wherein the phase change material includes water.

12. The storage apparatus of claim 1, wherein the phase change material includes Puretemp 1.

13. The storage apparatus of claim 1, wherein the phase change material exhibits a thermal resistance in a liquid phase that is higher than in a solid phase.

14. The storage apparatus of claim 1, further comprising a power source coupled to one or more of the controller and the thermoelectric heat pump.

15. The storage apparatus of claim 14, wherein the power source includes one or more photovoltaic panels.

16. The storage apparatus of claim 15, wherein the controller is configured to divert excess power produced by the photovoltaic panels to one or more external loads.

17. The storage apparatus of claim 16, further comprising a USB charging port operably coupled to the controller.

18. The storage apparatus of claim 17, wherein at least one of the one or more external loads can be produced by a device connected to the USB charging port.

19. The storage apparatus of claim 15, wherein the controller is programmed to receive varying voltage from the one or more photovoltaic panels and supply power to the thermoelectric heat pump at one or more predetermined voltages.

20. The storage apparatus of claim 19, wherein the controller is programmed to vary the predetermined voltage at least based on a temperature of one or more of the storage compartment or the thermal transfer assembly.

21. The storage apparatus of claim 20, wherein the controller is programmed to control the thermoelectric pump in a manner that maintains a predetermined temperature range in the storage compartment.

22. The storage apparatus of claim 21, wherein the predetermined temperature range is about 2° C. to about 8° C.

23. The storage apparatus of claim 1, wherein the controller is configured to control power delivered to the thermoelectric heat pump.

24. The storage apparatus of claim 1, wherein the heat sink include a cooling fan.

25. The storage apparatus of claim 24, wherein the controller is configured to selectively provide power to one or more of the controller, thermoelectric heat pump, or the cooling fan of the heat sink.

26. The storage apparatus of claim 1, further comprising a freezer compartment adjacent to at least one of the storage compartment or the thermal transfer assembly and separated therefrom by at least one wall.

27. The storage apparatus of claim 26, wherein the freezer compartment includes:

a freezer space sized and shaped to house one or more freezable packs;

a plurality of additional heat pipes in thermal communication with the freezer space; and an additional thermoelectric heat pump in thermal communication with the plurality of additional heat pipes.

28. The storage apparatus of claim 27, wherein the controller is programmed to distribute power from a power source to the additional thermoelectric heat pump.

29. The storage apparatus of claim 1, wherein at least one of the one or more heat pipes is a wicked heat pipe.

30. The storage apparatus of claim 29, wherein the at least one of the one or more heat pipes includes a coolant therein.

31. The storage apparatus of claim 30, wherein the coolant includes at least one or more of methanol, ammonia, anhydrous ammonia, or propylene.

32. The storage apparatus of claim 27, wherein the one or more additional heat pipes is in thermal communication with a plurality of thermally conductive plates, and the plurality of thermally conductive plates are in thermal communication with the freezer space.

33. The storage apparatus of claim 32, further comprising an urging mechanism configured to press one or more freezable packs against a wall of the freezer space.

34. The storage apparatus of claim 26, further comprising a chamber at least partially surrounding the freezer compartment, the chamber including an additional phase change material therein.

35. The storage apparatus of claim 26, further comprising a second temperature sensor configured to measure temperature in the freezer compartment.

36. The storage apparatus of claim 35, further comprising a display operably coupled to the second temperature sensor and configured to display temperature sensed by the second temperature sensor.

37. The storage apparatus of claim 1, further comprising a display operably coupled to the controller and configured to display temperature sensed by the at least one temperature sensor.

38. The storage apparatus of claim 1, wherein the thermal transfer assembly includes a heat transfer side in thermal communication with the storage compartment, and the heat transfer side include a recess therein.

39. The storage apparatus of claim 38, further comprising thermal insulation located in the recess.

40. A method of maintaining at least one temperature-sensitive material in a storage apparatus at a temperature lower than an ambient temperature, the method comprising:

placing the at least one temperature-sensitive material in a storage compartment of the storage apparatus that is adjacent to and in thermal communication with a thermal transfer assembly of the storage apparatus having a phase change material disposed therein; and controllably changing a phase of a portion of the phase change material by removing heat therefrom via one or more heat pipes attached to a thermoelectric heat pump so that a first portion of the phase change material is in a solid phase and a second portion of the phase change material is in a liquid phase that is disposed between the storage compartment and the first portion.

41. The method of claim 40, further comprising controlling the thermoelectric heat pump to remove heat from the phase change material responsive to a change in temperature in one or more of the storage compartment, the thermal transfer assembly, or the phase change material.

42. The method of claim 41, wherein controlling the thermoelectric heat pump to remove heat from the phase change material responsive to a change in temperature in one or more of the storage compartment, the thermal transfer assembly, or the phase change material includes maintaining a temperature in the storage compartment in a range of about 2° C. to about 8° C.

43. The method of claim 40, wherein controllably changing a phase of a portion of the phase change material by removing heat therefrom via a thermoelectric heat pump includes transferring heat from the change phase material to one or more heat pipes.

44. The method of claim 43, further comprising transferring heat from the one or more heat pipes to the thermoelectric heat pump, thereby cooling the one or more heat pipes.

45. The method of claim 40, further comprising distributing power from one or more photovoltaic panels to the thermoelectric heat pump.

46. The method of claim 45, further comprising diverting excess power from the photovoltaic panels to one or more external loads.

47. The method of claim 45, further comprising regulating a voltage supplied to the thermoelectric pump.

48. A storage apparatus for storing at least one temperature-sensitive material at a controlled temperature, the storage apparatus comprising:

an enclosure structure including, a storage compartment configured to hold the at least one temperature-sensitive material;

a thermal transfer assembly adjacent to and in thermal communication with the storage compartment, the thermal transfer assembly including, a phase change material disposed therein; and a plurality of heat pipes positioned at least partially within the phase change material; and a plurality of thermally conductive fins in thermal communication with the plurality of heat pipes, the plurality of thermally conductive fins oriented substantially horizontally;

a thermoelectric heat pump in thermal communication with the plurality of heat pipes; and a controller operably coupled to the thermoelectric heat pump and programmed to controllably cool the phase change material;

wherein at least one of a size, shape, or material of the plurality of thermally conductive fins and the plurality of heat pipes are selected in combination with power to be provided to the thermoelectric heat pump to partially control a freezing profile of the phase change material so that a portion of the phase change material adjacent to the storage compartment is not frozen.

* * * * *